US010434020B2

(12) United States Patent
Sason

(10) Patent No.: US 10,434,020 B2
(45) Date of Patent: Oct. 8, 2019

(54) BED

(71) Applicant: Albert Sason, Petach Tikva (IL)

(72) Inventor: Albert Sason, Petach Tikva (IL)

( * ) Notice: Subject to any disclaimer, the term of this patent is extended or adjusted under 35 U.S.C. 154(b) by 656 days.

(21) Appl. No.: 15/104,527

(22) PCT Filed: Jan. 20, 2015

(86) PCT No.: PCT/IB2015/050437
§ 371 (c)(1),
(2) Date: Jun. 15, 2016

(87) PCT Pub. No.: WO2015/092782
PCT Pub. Date: Jun. 25, 2015

(65) Prior Publication Data

US 2016/0310335 A1 Oct. 27, 2016

(30) Foreign Application Priority Data

Dec. 22, 2013 (IL) ..... 230084

(51) Int. Cl.

| | |
|---|---|
| ***A61G 7/00*** | (2006.01) |
| ***A61G 7/015*** | (2006.01) |
| ***A61G 7/02*** | (2006.01) |
| ***A61G 7/057*** | (2006.01) |
| ***A47C 27/10*** | (2006.01) |

(52) U.S. Cl.
CPC ..... *A61G 7/0005* (2013.01); *A47C 27/10* (2013.01); *A61G 7/015* (2013.01); *A61G 7/02* (2013.01); *A61G 7/05769* (2013.01)

(58) Field of Classification Search
CPC ..... A61G 7/0005; A61G 7/047
See application file for complete search history.

(56) References Cited

U.S. PATENT DOCUMENTS

| | | | | |
|---|---|---|---|---|
| 3,778,848 | A | 12/1973 | Lyytinen | |
| 5,054,136 | A | 10/1991 | Inagaki | |
| 5,729,848 | A | 3/1998 | Yamagishi | |
| 6,802,088 | B1 | 10/2004 | Gruner | |
| 2002/0023297 | A1* | 2/2002 | Khait | A61G 7/0005 5/600 |
| 2002/0125179 | A1* | 9/2002 | Chang | A61G 7/0005 210/143 |

FOREIGN PATENT DOCUMENTS

| | | | |
|---|---|---|---|
| CN | 201127695 | Y | 10/2008 |
| WO | 02078491 | A1 | 10/2002 |
| WO | 2008069767 | A1 | 6/2008 |
| WO | 2011138660 | A1 | 11/2011 |

* cited by examiner

*Primary Examiner* — Eric J Kurilla
(74) *Attorney, Agent, or Firm* — Mark M. Friedman

(57) ABSTRACT

A nursing bed includes means for washing a patient who lies on the bed, without removing the patient from the bed. It comprises a plurality of inflatable cushions fixedly mounted on a base, and means for washing the patient comprising a moving brush and trough under the back of the patient. At least part of the cushions have one or more drainage channels made thereon, for allowing washing water and soap to flow down off the bed. The base is generally a flat surface. The base with the cushions mounted thereon form a mattress on the bed. Each cushion has an outlet usable for inflating and deflating the cushion.

18 Claims, 25 Drawing Sheets

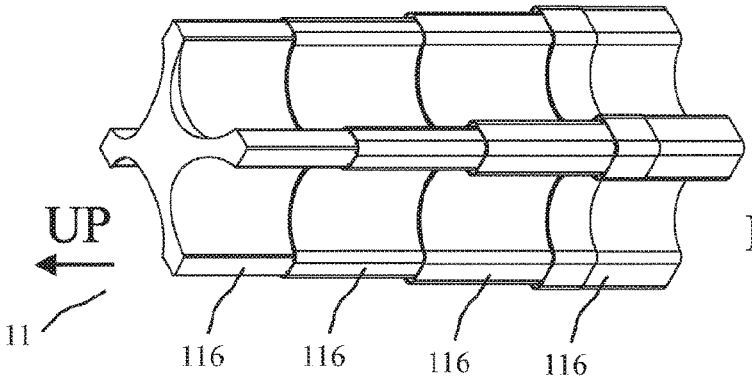
Fig. 29
Fig. 30
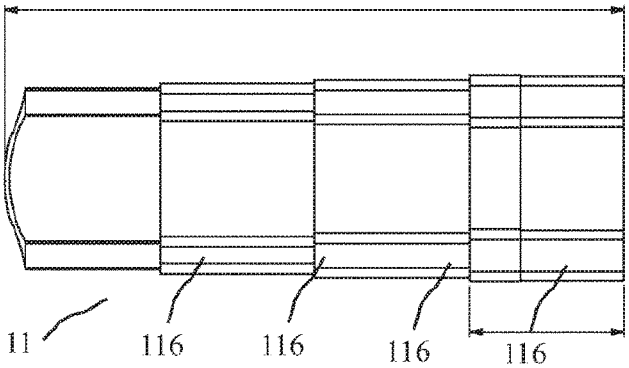
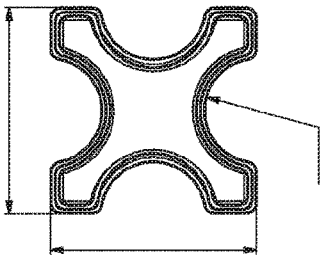
Fig. 31
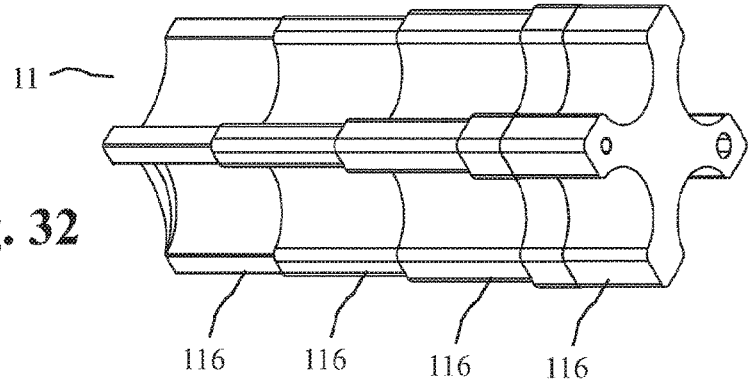
Fig. 32

BED

BACKGROUND

The present application claims priority from Patent Application No. 230084 filed in Israel on 22 Dec. 2013.

TECHNICAL FIELD

The present invention relates to improvements in patients washing devices, and more specifically a bed including means for washing a patient laying thereon.

DESCRIPTION OF RELATED ART

Impaired persons laying in beds face an acute hygienic problem, how to keep their body clean. This problem is also shared by senior persons, geriatric patients, people with disabilities, etc; in hospitals, nursing homes, homes for the aged or at their own home.

Body cleanliness greatly affects a person's health and human dignity.

The present inventor become aware of this problem while treating his parents during their terminal illness; he found that personal hygiene is very problematic in hospitals and homes for the aged, this for various reasons such as a patient's weight, their bodily condition, their physical condition, their psychological condition, etc.

It may be difficult to take the patient to washing facilities, and to do so at frequent intervals as required.

These and other problems in prior art facilities for impaired persons are addressed with the present invention.

SUMMARY OF THE INVENTION

The present invention comprises a bed with means for washing a patient who lies on the bed, without removing the patient from the bed.

According to one aspect of the present invention, the bed is made of a plurality of cushions having drainage channels made thereon, for allowing washing water and soap to flow down off the bed.

Furthermore, each cushion is inflatable and includes an inflation inlet and a deflation outlet thereon.

According to another aspect of the present invention, the bed includes means for washing the lower part of the patient's body, that is the part of the patient's body which faces the bed.

These means includes a mattress made of a plurality of inflatable cushions mounted on a common base, a rotating brush movable along the patient's back and a trough located between the rotating brush and the mattress.

According to yet another aspect of the present invention, the bed includes means for partially deflating part of the cushions which are located below the trough; thus, the majority of the cushions support the patient's body, whereas several cushions give way to the trough with the rotating brush.

Reservoirs for clean water and waste may be located under the bed, or the bed may be connected to suitable outlets in a hospital premises.

According to yet another aspect of the invention, additional rotating brushes are used to wash the patient's front and sides, with emphasis on locations which need additional care.

Furthermore, the bed includes means for drying up the patient's body and mattress; means for removing the used sheet and replacing it with a clean sheet; means for allowing the patient to defecate into an excrements reservoir rather than on the bed; and means for cleaning the patient's behind after defecating.

Further purposes and benefits of the current invention will become apparent to persons skilled in the art upon reading the present disclosure and the related drawings.

BRIEF DESCRIPTION OF THE DRAWINGS

Embodiments of the invention are disclosed hereinafter with reference to the drawings, in which:

FIG. 29 illustrates an isometric/top view cushion in its inflated state.

FIG. 30 illustrates a side view of the cushion.

FIG. 31 illustrates a top view of the cushion.

FIG. 32 illustrates an isometric/bottom view of the cushion.

DETAILED DESCRIPTION OF THE INVENTION

The current invention will now be described by way of example and with reference to the accompanying drawings.

Figure 1A:
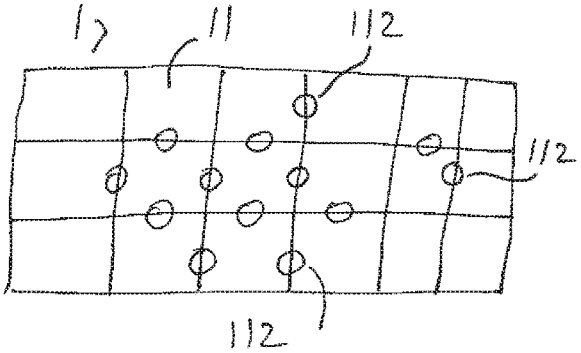
FIGS. 1A and 1B illustrate a top view and a side view, respectively, of a patient's bed.
Figure 1B:
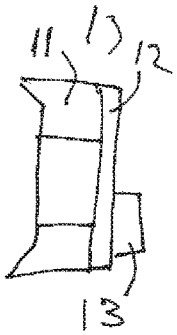

Referring to FIGS. 1A and 1B, which illustrate a top view and a side view, respectively, of a patient's bed 1, the present invention comprises a bed 1 with means for washing a patient who lies on the bed, without removing the patient from the bed.

The bed 1 includes a plurality of cushions 11, all fixedly mounted on a base plate 12 underneath, and a waste collection reservoir 13.

Each cushion 11 has one or more channels for draining water and soap 112 off the surface of the bed to the reservoir 13.

Thus, the bed 1 is made of a plurality of cushions 11 having drainage channels 112 made thereon, for allowing washing water and soap to flow down off the bed.

Furthermore, each cushion is inflatable and includes an inflation inlet and a deflation outlet thereon.

Figure 2A:
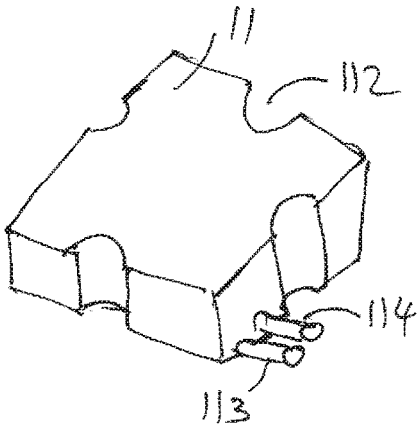
FIGS. 2A and 2B illustrate two embodiments of a cushion for a patient's bed.
Figure 2B:
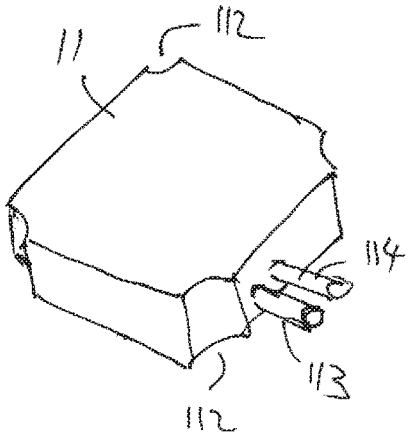

FIGS. 2A and 2B illustrate two embodiments of a cushion 11 for a patient's bed.

Each cushion 11 includes one or more channels for draining water and soap 112, which may be made along the sides of the cushion as illustrated.

Each cushion may further include an inflation inlet 113 and a deflation outlet 114.

Preferably, each cushion is generally shaped as a cube with each side of 5 to 10 centimeters (cm); other dimensions may be used.

According to another aspect of the present invention, the bed 1 includes means for washing the lower part of the patient's body 2, that is the part of the patient's body which faces the bed.

These means includes a mattress made of a plurality of inflatable cushions 11 mounted on a common base, a rotating brush 32 movable along the patient's back and a trough 31 located between the rotating brush and the mattress.

According to yet another aspect of the present invention, the bed 1 includes means for partially deflating part of the cushions 11 which are located below the trough 31; thus, the majority of the cushions 11 support the patient's body 2, whereas several cushions give way to the trough with the rotating brush.

Figure 3:
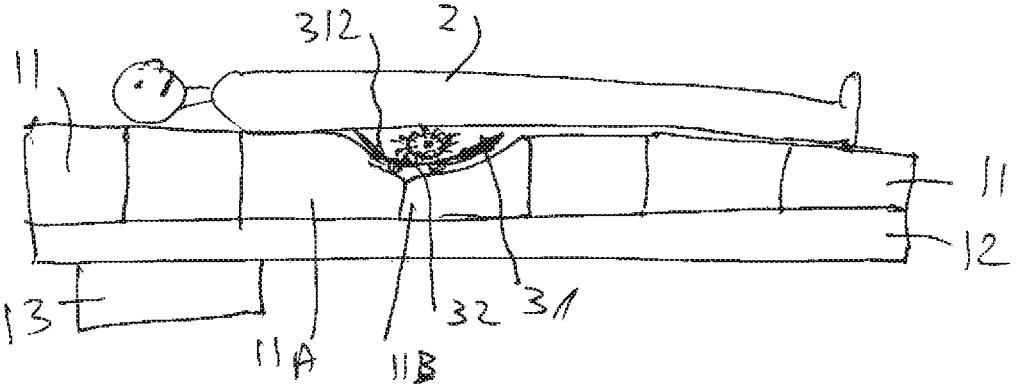
FIGS. 3 and 4 illustrate a patient's bed with washing means thereon.
Figure 4:
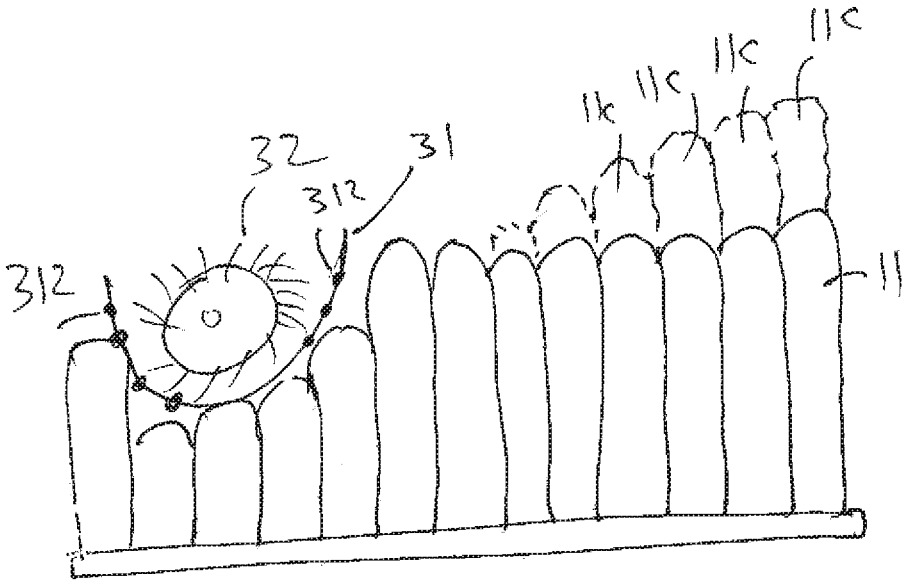

FIGS. 3 and 4 illustrate a patient's bed with washing means thereon.

As the patient 2 lays on the bed 1, inflatable cushions 11 take the general shape of the patient's body for comfort; furthermore, there is a cylindrical-shaped rotating brush 32 mounted above a trough 31; the brush and trough assembly may be move along the patient's back to wash it.

As the brush and trough are moved along the bed, cushions momentarily located under the trough may be depressed, as illustrated with depressed cushions 11A, 11B. The body is supported by the non-depressed cushions.

Furthermore, cushions may raise to adapt to the patient's body in a specific posture, such as illustrated with cushions 11C.

The cushions 11 are mounted on a base plate 12.

There are holes 312 in the trough 31, for water and soap to flow out of the trough and, through the channels 112, to a waste collection reservoir 13.

Water and liquid soap supplies are connected to the brush 31 for the purpose of washing the patient.

The brush and trough may move along a flexible groove, to adapt their height to the height of the cushions 11.

Figure 5:
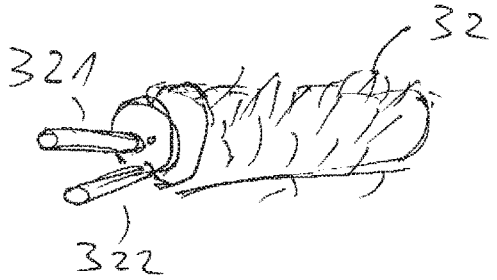
FIG. 5 illustrates washing means with water and liquid soap supplies.

FIG. 5 illustrates washing means with water and liquid soap supplies, which include a rotating brush 32 with a water inlet 321 and a liquid soap inlet 322.

Thus, as the brush 32 moves along the patient's body, it rotates to wash the patient, while water and soap are supplied to that purpose.

Figure 6:
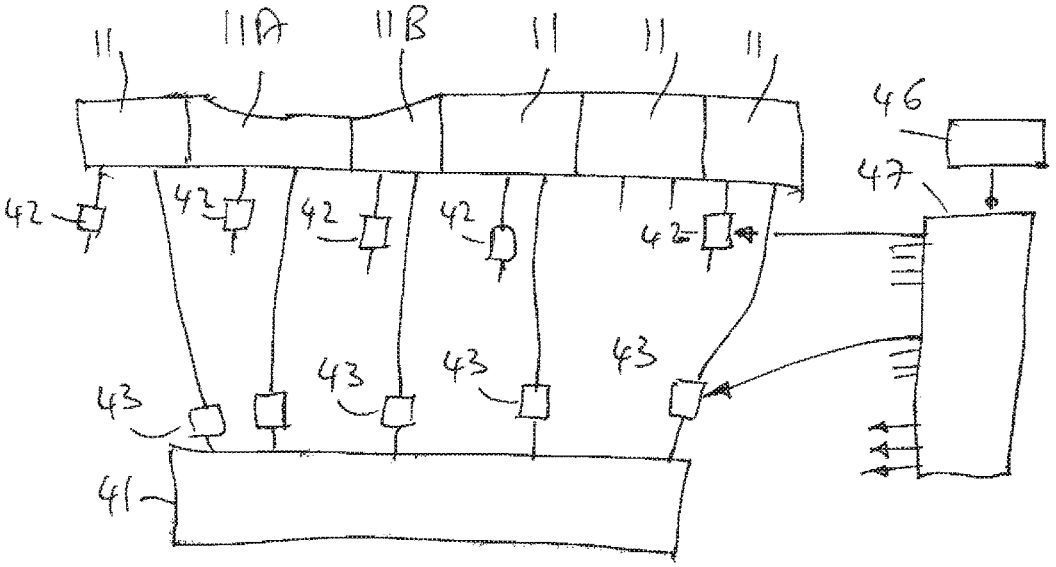
FIG. 6 illustrates a systems for cushions inflation.

FIG. 6 illustrates a systems for cushions inflation.

The cushions 11 support the patient's body, whereas depressed cushions 11A, 11B allow the passage of the trough 31 thereon.

A microcomputer 47 may be used to control the state of each cushion 11: each cushion may be individually inflated by activating an inflation valve 43 to connect it to a pressurized air supply accumulator 41.

A cushion may be deflated under microcomputer control by activating its corresponding deflation valve 42.

A trough location sensor 46 may be used to report to the microcomputer the instantaneous location of the trough 31, so the microcomputer will know which cushions to deflate; then inflate them again, when the trough moves to another location. And so the process is repeated as the through moves on.

Reservoirs for clean water and waste may be located under the bed; or, the bed may be connected to suitable outlets in a hospital premises.

Figure 7:
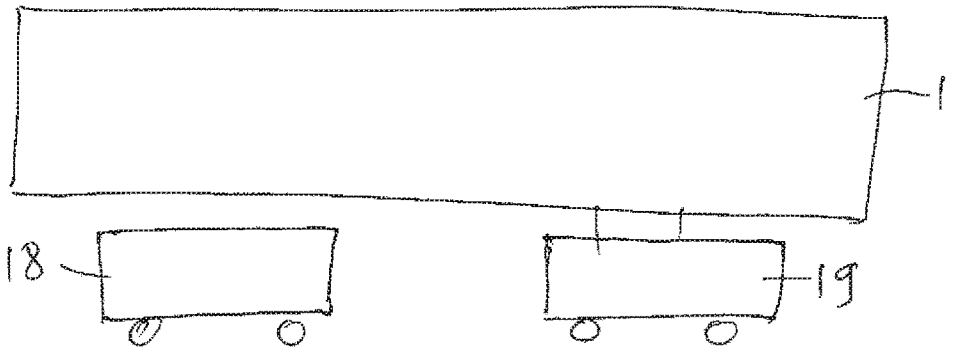
FIG. 7 illustrates a bed with water supply and waste collection.

FIG. 7 illustrates a bed with water supply and waste collection.

Thus, the washing device may include a clean water reservoir 18 and a waste collection reservoir 19.

According to yet another aspect of the invention, additional rotating brushes are used to wash the patient's front and sides, with emphasis on locations which need additional care.

Figure 8:
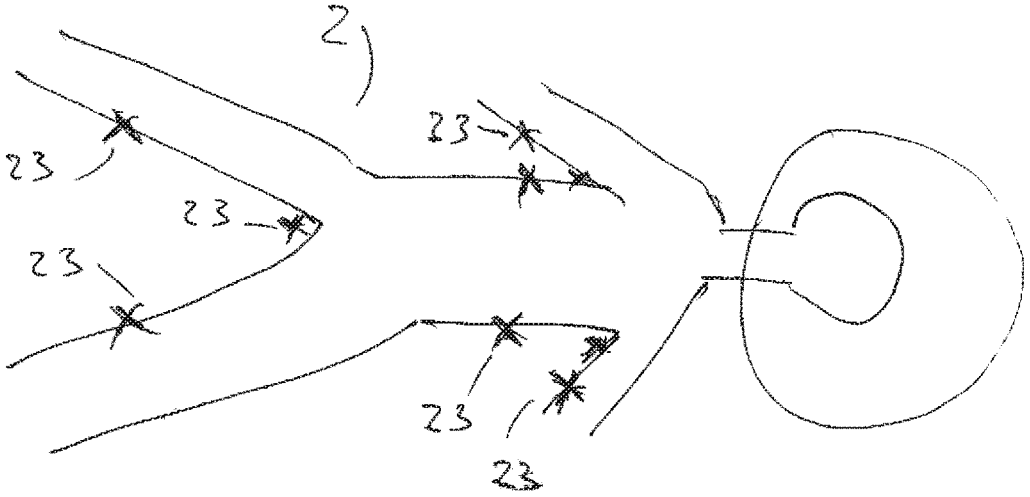
FIG. 8 illustrates critical locations to wash on a patient's body.

FIG. 8 illustrates critical locations to wash 23 on a patient's body 2. The present invention include means for paying more attention to these more difficult to reach locations.

Figure 9:
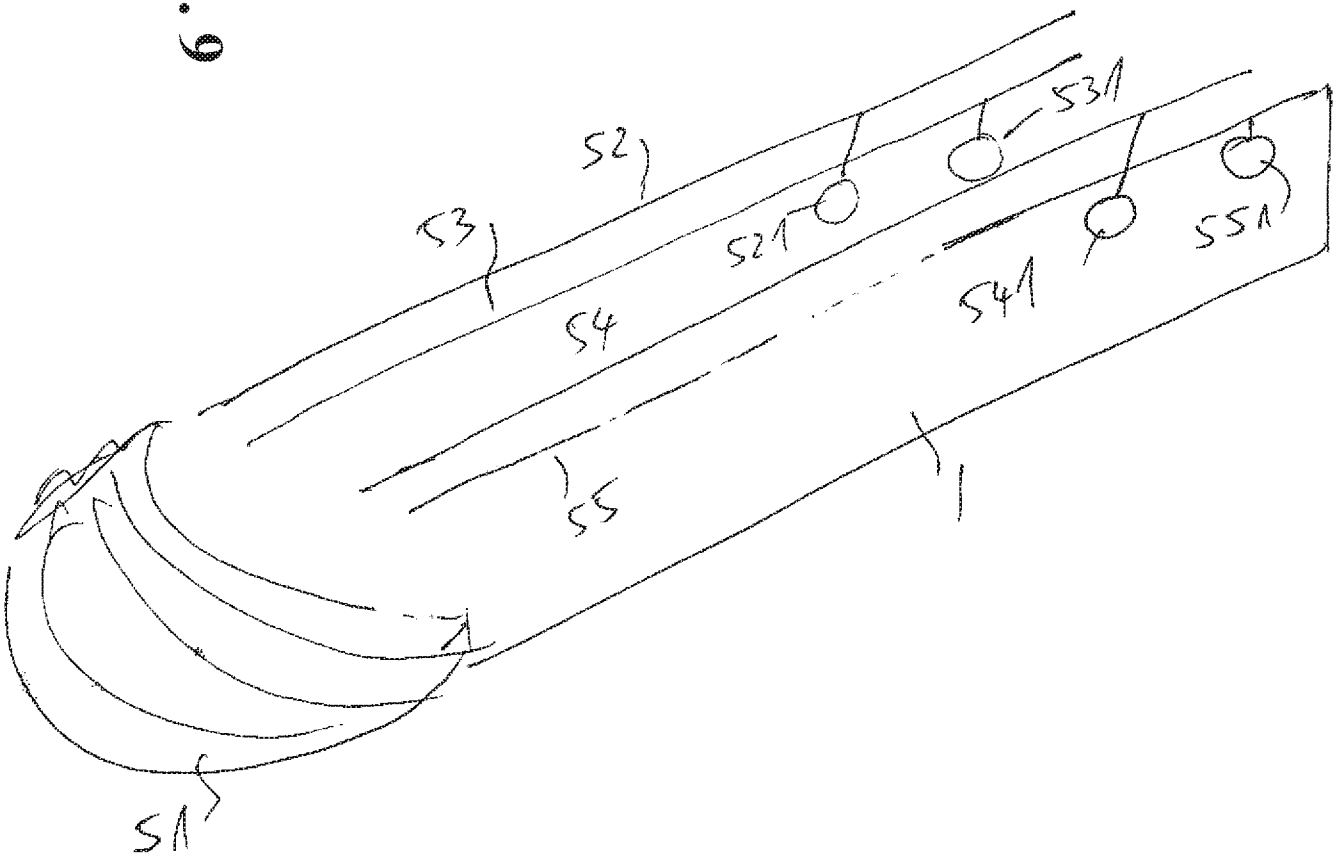
FIG. 9 illustrates a bed with means for washing the top and sides of a patient's body.

FIG. 9 illustrates a bed with means for washing the top and sides of a patient's body.

The bed 1 may include a foldable transparent cover 51 mounted at one of its ends; the cover may be extended to cover the patient's body when washing him/her, so as not to spill water and soap outside the bed. In its folded state, the cover 51 will not disturb the patient; during washing, an attendant may survey the washing process through the transparent surface of cover 51.

The brushes 521, 531, 541, 551 may be moved along the bed while they are mounted on their respective rails or grooves 52, 53, 54, 55.

Figure 10:
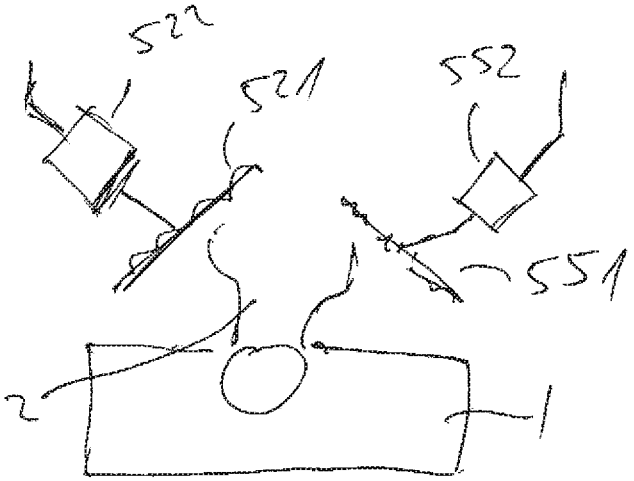
FIG. 10 illustrates means for washing the top and sides of a patient's body.

FIG. 10 illustrates a side view of means for washing the top and sides of a patient's body.

The bed 1 with the patient 2 laying thereon, has the brushes 521, 551 which are rotated by the motors 522, 552. The motors may be pneumatic or electrical.

Preferably, non-electrical rotating means are used, to prevent the danger of patient's electrocution.

Figure 11:
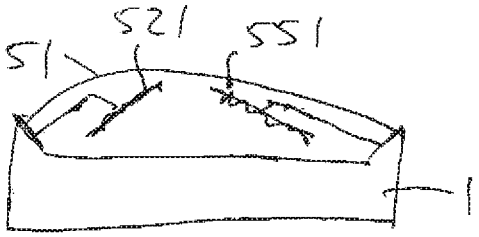
FIG. 11 illustrates cover and means for washing the top and sides of a patient's body.

FIG. 11 illustrates cover and means for washing the top and sides of a patient's body.

The bed 1 with a transparent cover 51, also has brushes 521, 551 as detailed above.

Furthermore, the bed may include means for drying up the patient's body and mattress;

means for removing the used sheet and replacing it with a clean sheet;

means for allowing the patient to defecate into an excrements reservoir rather than on the bed;

and means for cleaning the patient's behind after defecating.

The means for allowing the patient to defecate into an excrements reservoir rather than on the bed may include an inflatable ring activated under patient's control to separate adjacent cushions located near the patient's behind, so as to form a passage through the mattress down into an excrements reservoir.

The reservoir may have a cover which is automatically open during this process and closed again thereafter, to prevent bad odors in the air.

The means for cleaning the patient's behind after defecating may include a rotating brush with means for raising it from under the bed, after defecation; suitable water and soap supplies may be used for efficiently washing the patient.

Figure 12:
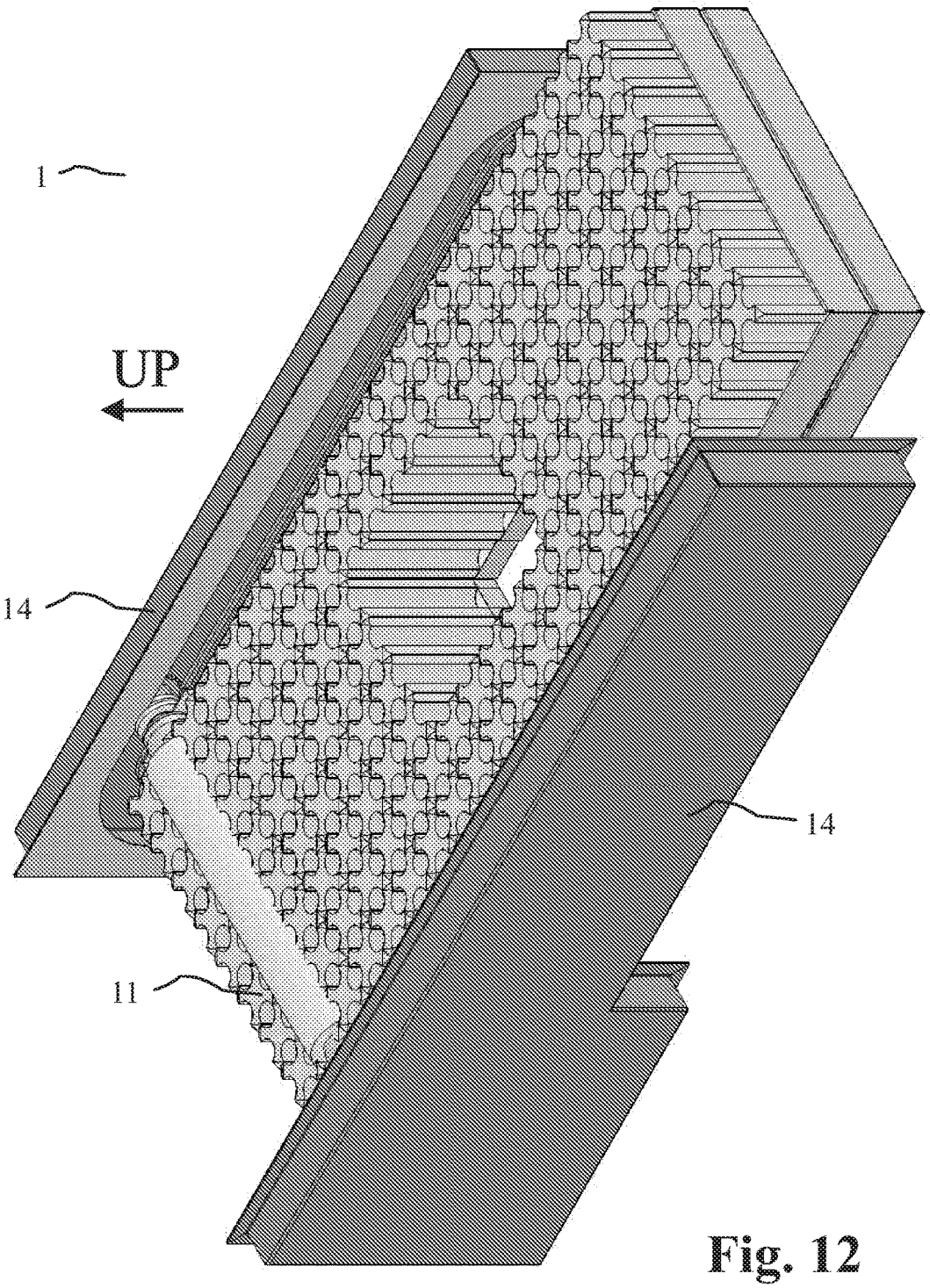
FIG. 12 illustrates the lower part of the bed, with inflatable cushions and side protectors.

FIG. 12 illustrates the lower part of the bed 1, with inflatable cushions 11 and side protectors 14.

Patient's Back Washing

A plurality of cushions are mounted adjacent to each other in a two-dimensional structure to form a mattress.

Each cushion has a telescopic structure with a balloon contained therein. The cushion is so devised that, when the balloon is inflated, it pushes the telescopic parts apart. Preferably there are three telescopic parts. Preferably the balloon is made of a polymeric material having elasticity properties and abrasion resistance.

An air hose is connected to the base of the balloon (at the lower part of the bed, located toward the floor). When inflating the balloon, the balloon makes the three telescopic parts to rise up, akin to a cylinder moving up or down.

All the air hoses to all the balloons are connected to an accumulator (a pressure reservoir with an internal diaphragm, which generates a constant air pressure for the bed system). The reservoir is connected to a compressor which generates a constant air pressure. Thus, all the cushions are at a constant inner pressure.

A valve is connected to the hose leading to each cushion. In a first state of the valve, air pressure from the accumulator is connected to the cushion; in a second state of the valve, the cushion is disconnected from the air pressure and a path to the ambient air is created, to release the air pressure off the cushion. Thus, by controlling the valve assigned to each cushion, it is possible to inflate or deflate that cushion.

One application of this structure is to use most of the cushions to support the patient's body, whereas some part of the body are left intentionally unsupported.

This feature may be useful to prevent pressure to certain parts of the patient's body (such as bed sores or wounds).

Optionally, on the upper part of each cushion is installed a chemicals sensitive detector, that is sensitive to a specific chemical which is applied to the wound. Thus, if a cushion comes into contact with a wound on patient's body, the detector will cause that cushion to deflate.

This achieves an adaptive mattress, which senses wounds in patient's body; the section where there is pressure sore on the body of the patient is not supported from the mattress and a kind of hole in the mattress is thus created.

All the cushions are at a constant, predefined pressure; if pressure is applied to one of the cushions, the diaphragm in the accumulator will move or shrink, to preserve the designated air pressure.

The base of the mattress is made of a beehive of cubes, each cube comprising the base of one cushion. When the cushion is deflated, its telescopic parts enter the cubic part of that cushion.

At the bottom of the cushion base there is the connection between the cushion and the air supply tube. Each cushion is fixedly attached to its designated location on the mattress base.

Preferably the total height of each cushion is about 200 millimeters (mm), wherein about 50 mm thereof are inserted into said supporting cube.

The Trough

The trough is a half pipe (a cylindrical part whose cross section is a half circle), which is perforated to drain water which accumulate into it. One end of the trough is connected to a perforated tube which sprays water or soap.

The two ends of the trough are mounted on two tracks spanning the length of the bed. The axis of symmetry of the trough is normal to the bed's length, so the trough spans the width of the bed.

The system is so devised as to deflate the cushions which are under the trough at any given moment, and to inflate again the cushion the moment the trough has moved to another location.

In another embodiment, it is the pressure applied by the trough on the cushions which causes the cushions in that location to shrink (their height decreases), for the duration the trough is located above these cushions.

Thus, the brush will always be in contact with the patient's body.

The trough moves along the bed, wherein the trough's pressure on cushions causes them to contract and thus the trough level is below the mattress level.

The trough will always be about 50 mm below the patient's body being washed. In the trough is installed a brush (roller) which is attached with a hinge on both sides, these axes are connected to clutches installed at the ends of the trough (their role is described later).

The trough moves along the bed under the patient's body being washed and the perforated tube which is installed at the end of the trough splashes water or soap and the brush is rotating with friction with the body being washed.

The water or soap flow towards the body and the brush creates friction for mechanical cleaning.

Stack of Brushes

At the edge of the bed (at the bottom or over the bed) a cartridge is installed within which there are preferably six cylinders, including two cylinders of sponge for brushing, two rolls of towel for wiping and drying, and two rolls of bed sheet.

Upon termination of any action, and when the trough reaches the edge of the bed, the clutches on both sides of the trough open and the cylinder installed on the trough falls into the used rolls tray.

A monotonous action is the roll sponge which is connected when soaping and washing the patient. This roll is replaced with a towel roll which spins and wipes the body of the patient.

At the end of the two abovedetailed processes, the trough connects to roll the sheet, thus unfolding a fresh sheet under the body of the patient.

At the end of applying a fresh sheet, operation Roll the sheet, the trough reaches the edge of the bed (below the head of the patient), moves down towards its storage location and stays there until given another command, i.e. a situation where there is a need to remove the sheet from the mattress.

At the ends of each roll there are connected axes with friction discs. The roll axes are inserted into clutches located on either side of the trough. The clutches each also includes a friction disc. The friction disc mounted on the trough includes a spring which pushes it towards the roll disc, this resulting in these parts becoming one unit with maximal friction therebetween.

When the trough reaches its storage location, the clutches on its sides open and the roll falls down, wherein the trough is located opposite the next roll to be used. When the new roll is in location, the clutches close to hold the next roll for the coming operation.

Figure 13:
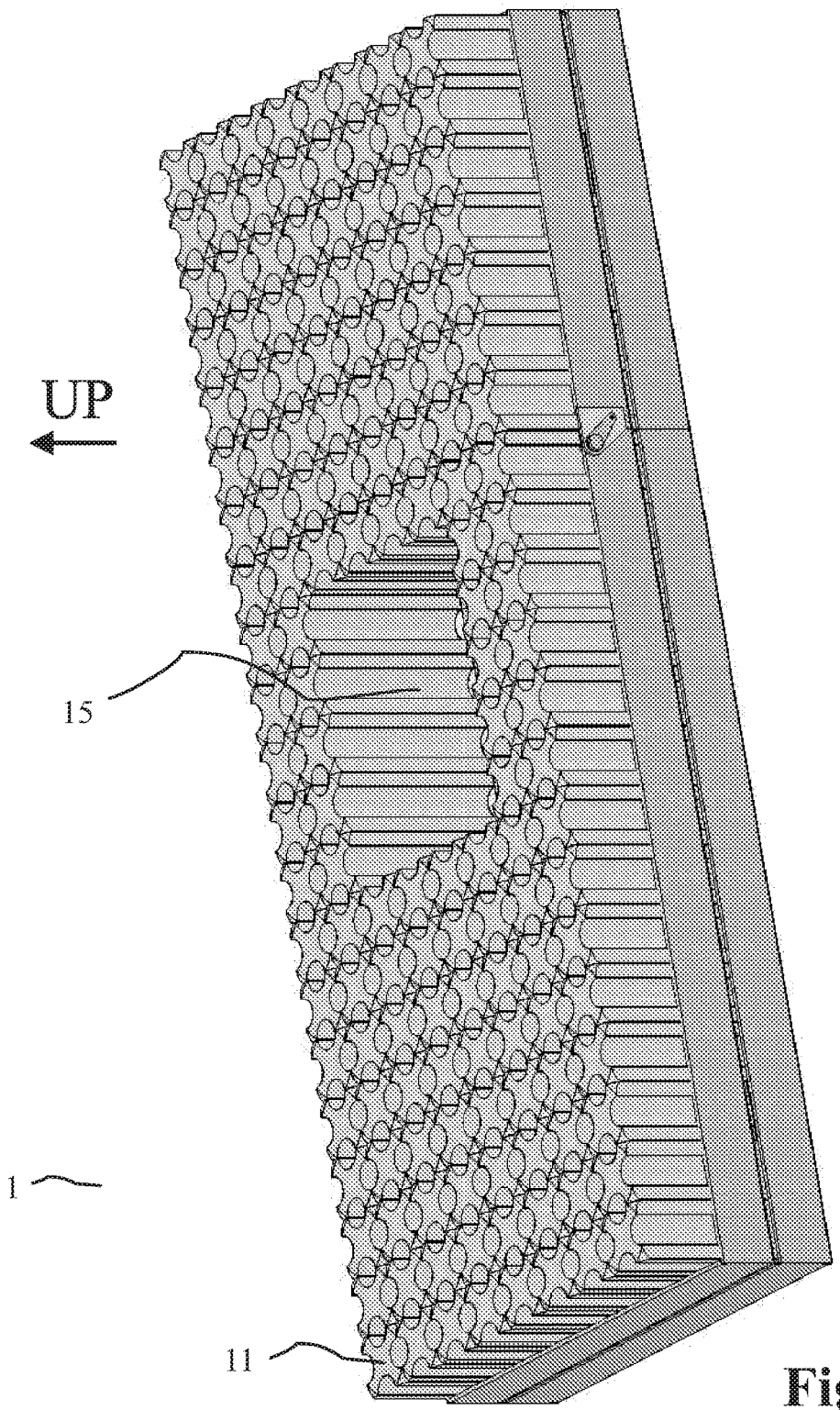
FIG. 13 illustrates the lower part of the bed, with inflatable cushions and opening for feces.

FIG. 13 illustrates the lower part of the bed 1, with inflatable cushions 11 and opening, or gap, for feces 15.

Feces Draining Opening

The mattress and the bed base are divided into two parts, the two parts are connected with an axis which is connected to a piston. Providing a suitable command will cause one section of the bed to rise, to support the upper body part of the patient in a sitting position.

At the end of half a mattress that does not rise (the section where the buttocks) is a cube of cushions, which disconnects or connects to bed responsive to a patient's command.

When disconnecting, this cube moves down and sideways; thus a gap is formed in the mattress at the location of the patient's buttocks. Under the gap appears a feces collection reservoir.

The same cylinder may be used both to move the cube which covers the gap, and to bring up the feces reservoir. When the patient needs to defecate, he/she may push a button and then:

The sheet roll moves toward the patient's feet, so there is no sheet between the buttocks and the mattress; the gap in the mattress opens and the feces reservoir is brought close to the gap. Patient's feces fall through the gap in the mattress into the feces reservoir or container.

When finished, the patient pushes a button to indicate this.

The feces reservoir moves down and its cover hermetically seals it to prevent bad odors in the room.

In the inner opening in the feces reservoir there are spray tubes which, at the end of defecating, spray with water under pressure the patient's buttocks and rectum.

The gap in the mattress is closed. The sheet roll moves toward the patient's head, and the sheet is deployed again.

Figure 14:
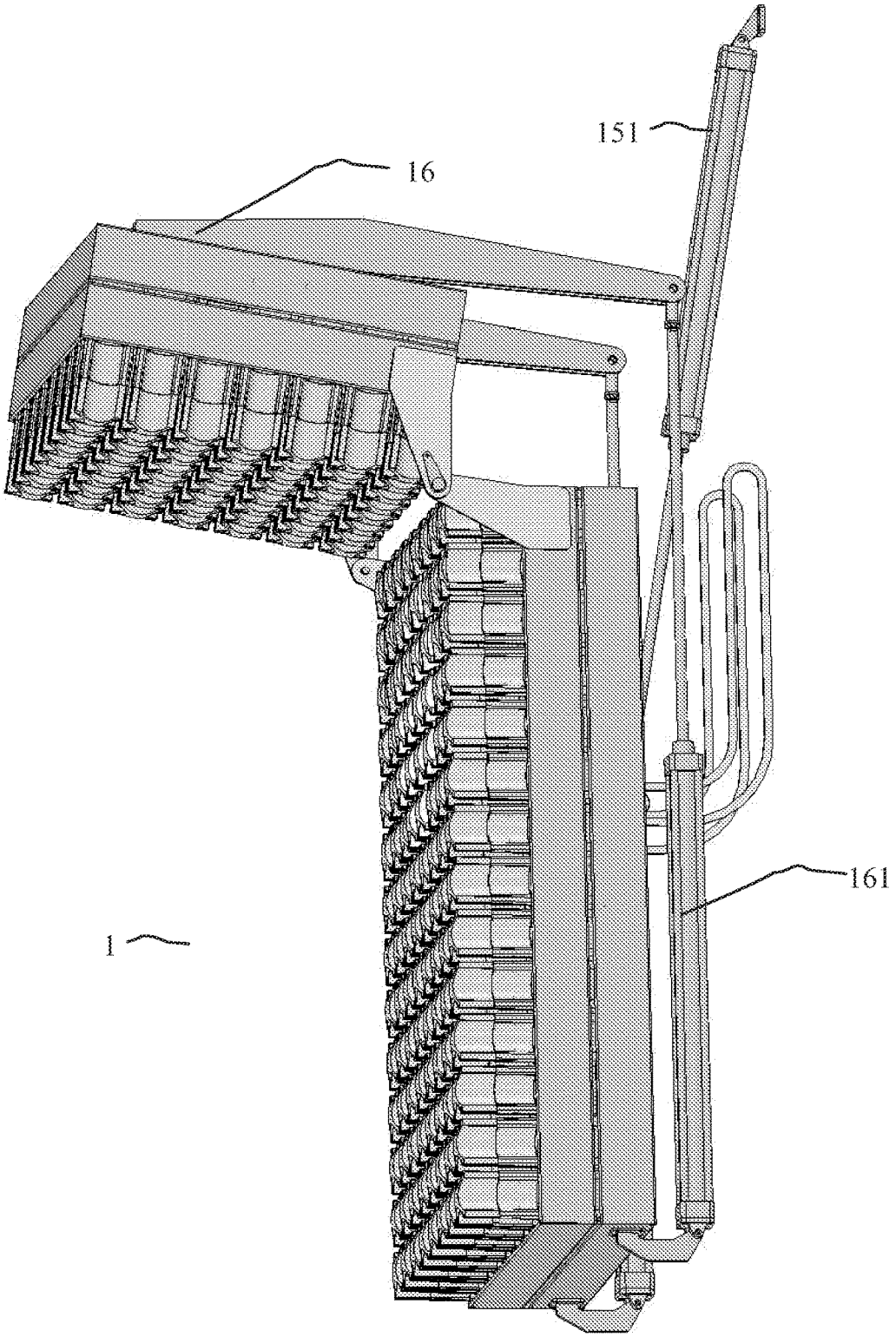
FIG. 14 illustrates the lower part of the bed, with upper body part of the bed in its upright position.

FIG. 14 illustrates the lower part of the bed 1, with upper body part of the bed 16 in its upright position.

The upper body part of the bed 16 may be raised (to a sitting position) or lowered (to a sleeping position) using the cylinder 161.

The bed further includes an opening for feces activating cylinder 151.

Figure 15:
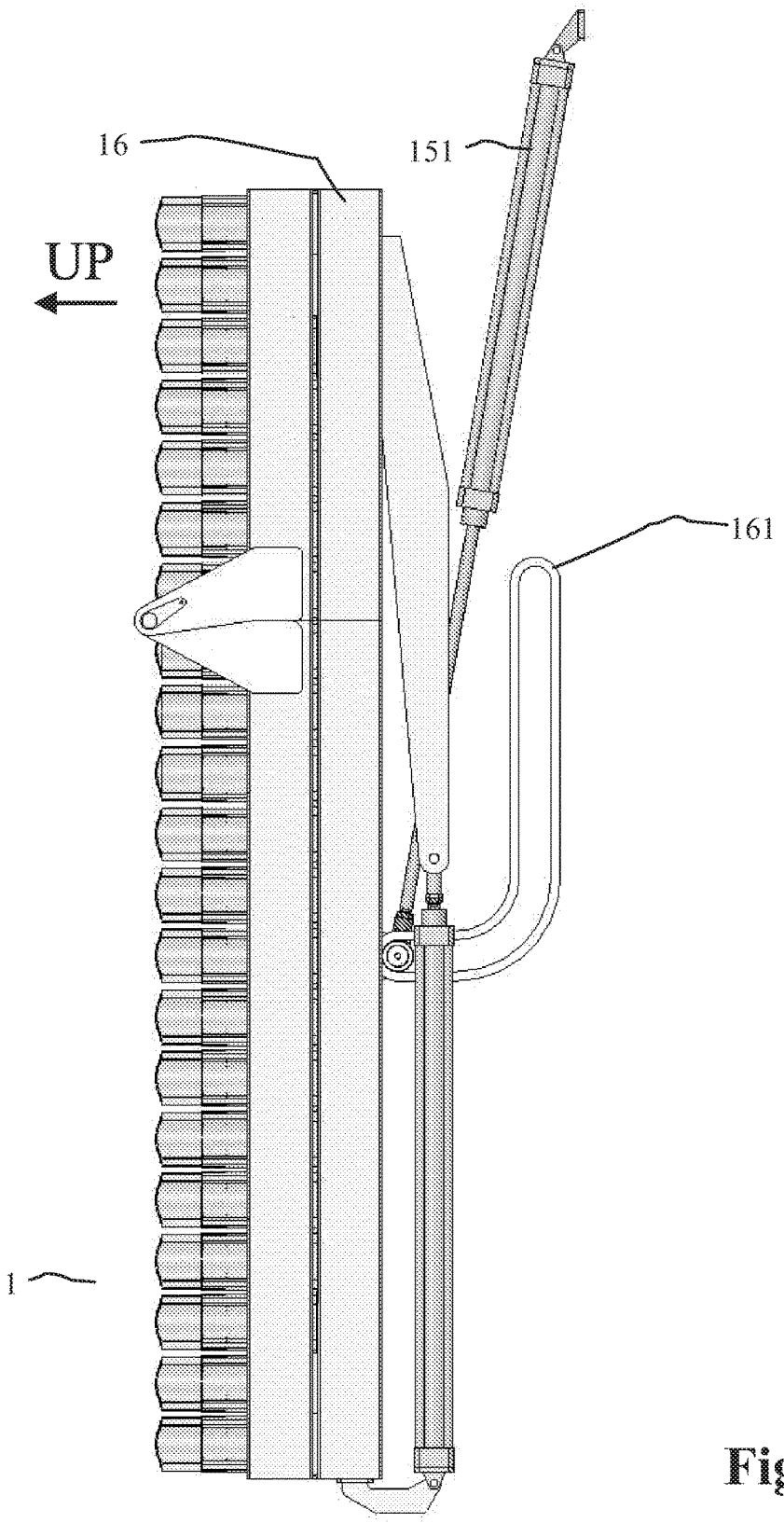
FIG. 15 illustrates the lower part of the bed, with upper body part of the bed in its horizontal position.

FIG. 15 illustrates the lower part of the bed 1, with the upper body part of the bed 16 in its horizontal position.

Figure 16:
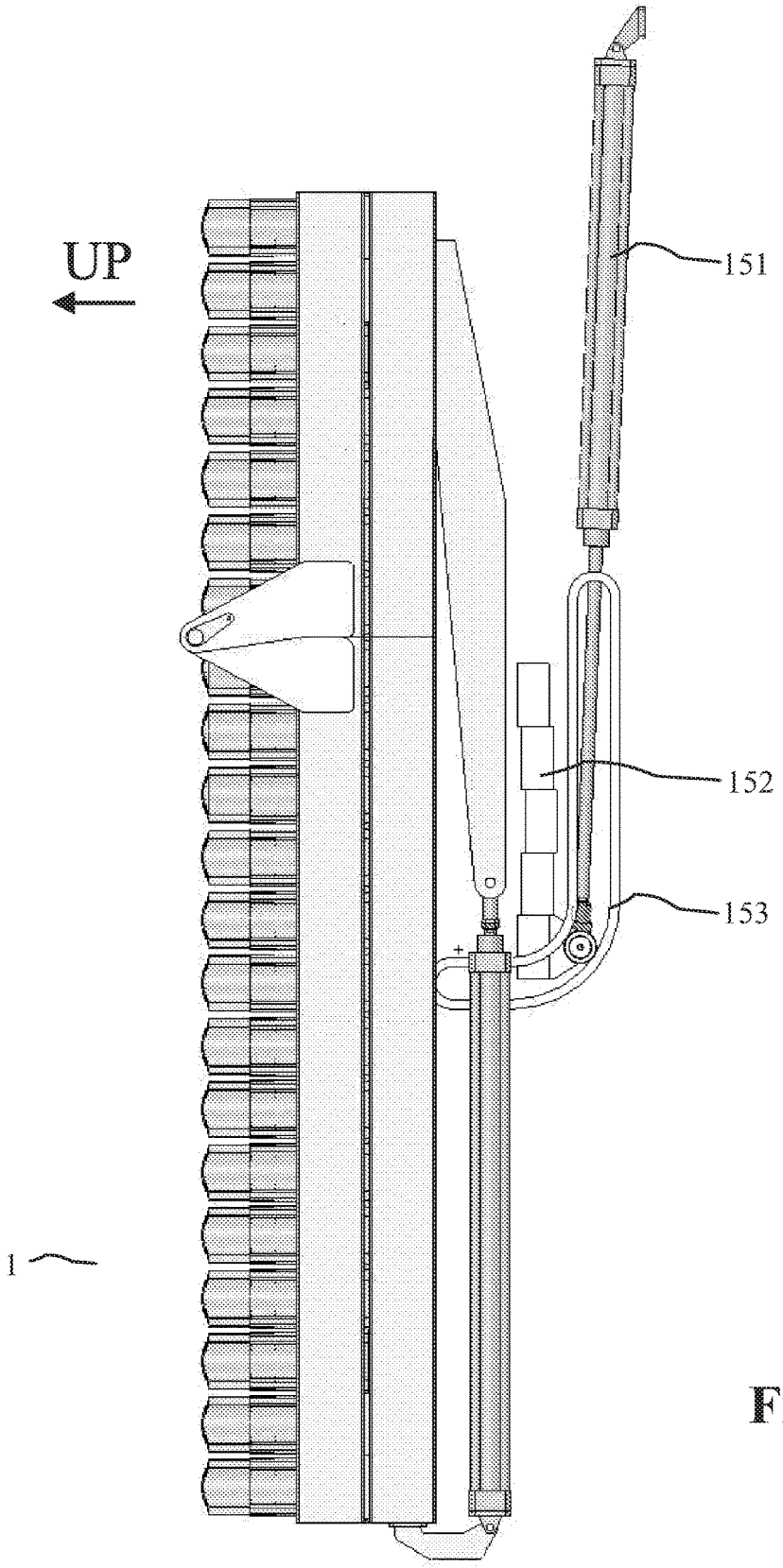
FIG. 16 illustrates the lower part of the bed, with inflatable cushions and opening for feces activating cylinder.

FIG. 16 illustrates the lower part of the bed 1, with inflatable cushions 11 and the opening for feces (gap) activating cylinder 151.

In the state as illustrated, the opening for feces activating cylinder 151 retracts, thus the cover 152 moves down along rail 153.

Figure 17:
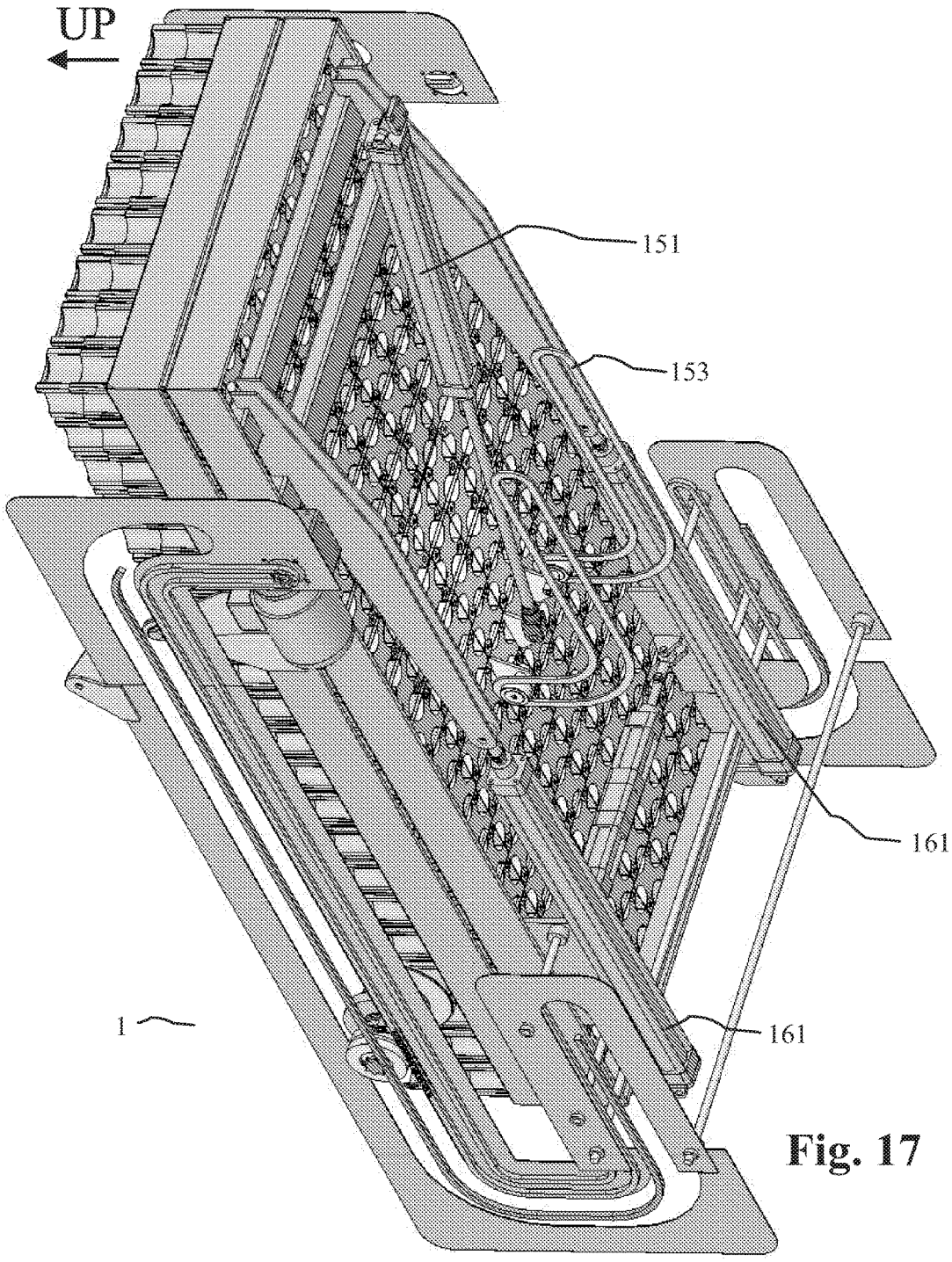
FIG. 17 illustrates a view from below the lower part of the bed, with means for activating the opening for feces.

FIG. 17 illustrates a view from below the lower part of the bed 1, with means for activating the opening for feces.

These means may include a rail for activating the opening for feces 153, upper body part of the bed 16 and upper body part of the bed cylinder 161.

Further illustrated is a feces collection container or reservoir 6.

The trough may move along the length of the bed guided by the rail for trough 311.

Figure 18:
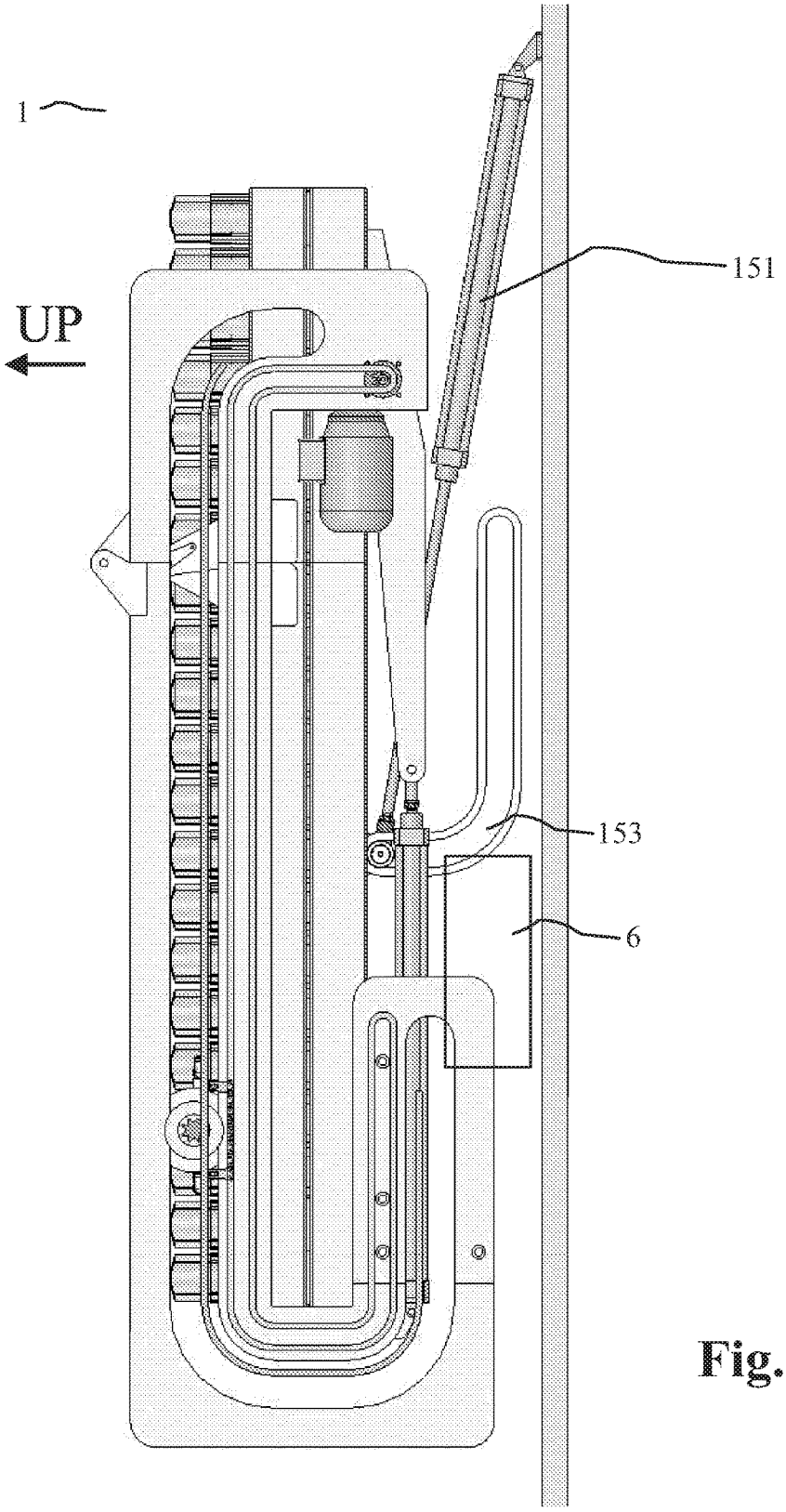
FIG. 18 illustrates a side view of the lower part of the bed.

FIG. 18 illustrates a side view of the lower part of the bed 1.

Shown are the rail for activating the opening for feces 153, the feces collection reservoir 6 and the rail for trough 311.

Figure 19:
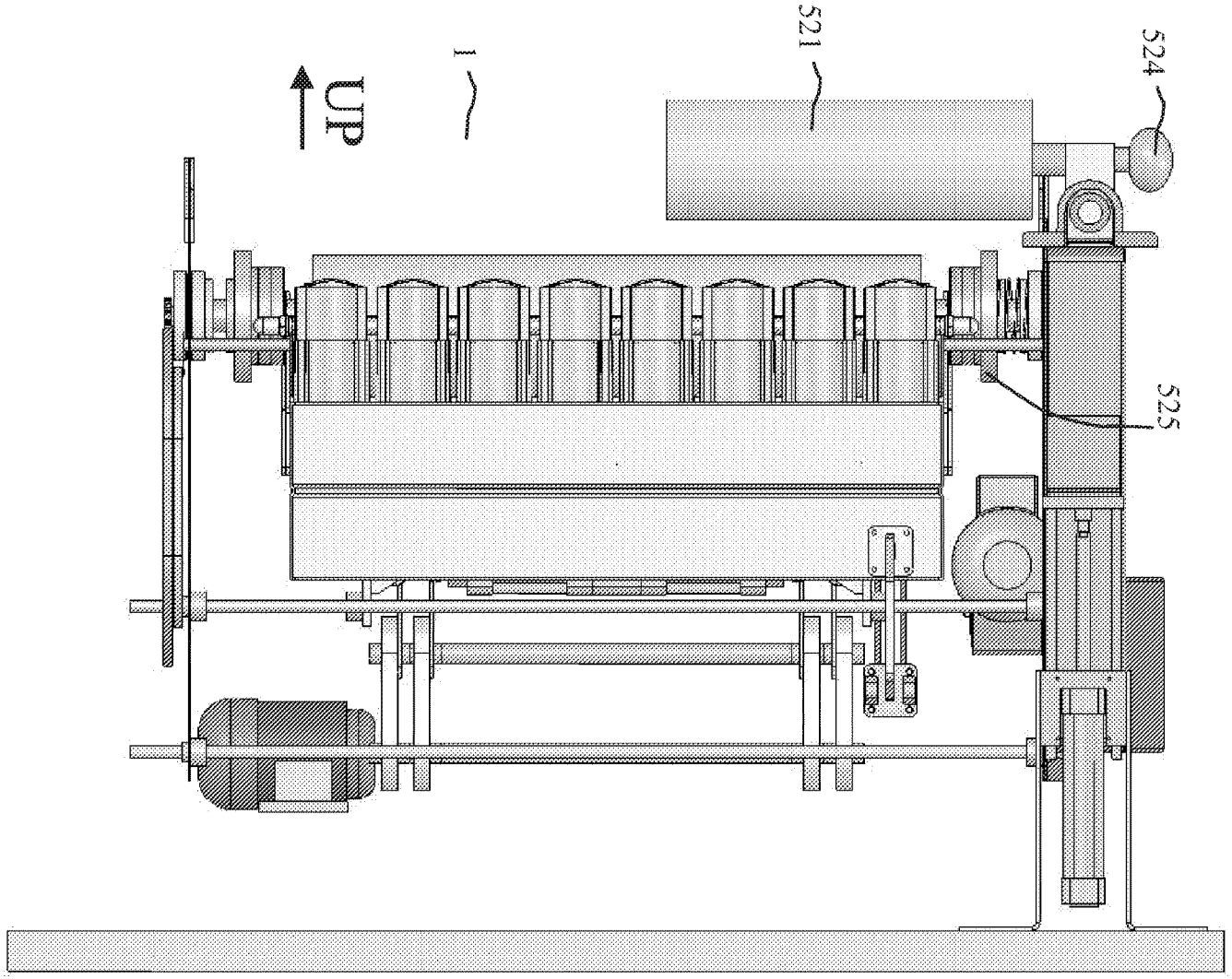
FIG. 19 illustrates means for washing the upper part of a patient's body.

FIG. 19 illustrates means for washing the upper part of a patient's body.

Shown are the bed 1, with the brush 521 and geared sphere 524. Sphere 524 allows the brush to rotate only when the brush is lowered to come into contact with the patient's body. If the patient pushes the brush away, the sphere causes the brush to cease rotating.

Further shown is the clutch 525.

Figure 20:
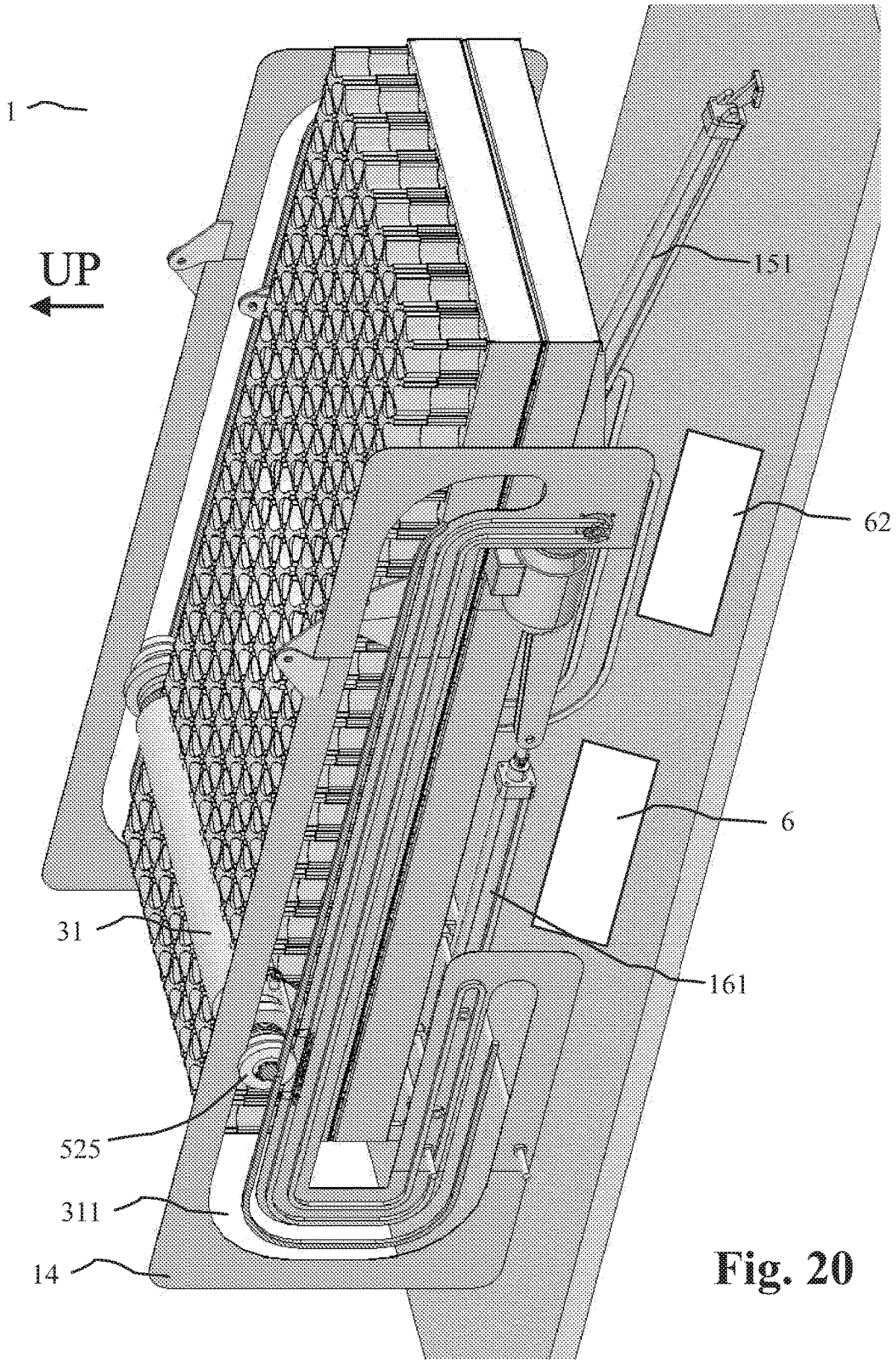
FIG. 20 illustrates the means for washing the upper part of a patient's body.

FIG. 20 illustrates the means for washing the upper part of a patient's body including:

a bed 1
a trough 31
a rail for trough 311
a clutch 525
side protectors 14
feces collection reservoir 6
upper body part of the bed cylinder 161
and opening for feces activating cylinder 151.

Water Tanks

At the bottom of the bed there are two containers that sit on wheels. The feces and urine container can be moved under the bed, where it is mounted on two rails. The rails lock on the container and allow its movement along a predefined path, either in its lower rest location or in its location near the gap in the mattress, when the patient is defecating and/or urinating.

The clean water container is brought to its location under the bed and is connected to the clean water pipes in the system, and to electric power. In the clean water installation there is a water pump with variable pressure, responsive to a command. A water heater mounted on-line can heat the water.

Optionally, water generated from condensating vapors can be collected and brought back to the container.

Thus, an additional tube of water returns to the container condensation water formed around the patient, which is clean water, with a blower installed in the bed.

It is possible to connect the bed to existing water and sewage infrastructure, thus saving the containers.

Patient's Front Part Washing 10

At the sides of the bed, spanning the bed's length, there are installed two rods on each side, wherein one side is lower than the other. Between these rods is a threaded helical rod. The two rods are connected to gears which moves along the round rod and is in contact through its gears, with the threaded rod.

The four brushes move along the bed and the movement thus generated includes both linear and rotational motion simultaneously.

Washing the sides of the upper body and parts of the upper body from both sides of the patient's body is accomplished by moving two cylindrical brushes (rollers), each covering half the body of the patient. The brushes move along the bed on rods as abovedetailed. At the bottom of the pole there is a helical screw along the bed, which turns and thus drives the gear installed above the pole, causing the brush to make two motions simultaneously, rotation on its axis as well as movement along the bed.

The gear is so devised that, if the patient pushes it upwards and away for any reason, the brush stops rotating. Thus, the roller will rotate only when it is in contact with the patient's body.

The gear is lower that the upper surface of the patient's body, therefore the cylindrical brushes from the two sides of the bed will move while they have a slant orientation.

The cylindrical brushes, each against each other, cover the patient's body with a measure of overlap.

Small Upper Brushes

Their role is to wash the inside of the foot and thigh, the groin and underarms.

The small brushes are connected to the gear connected to the higher rod along the sides of the bed. Together these brushes form a V shape.

While moving along the bed, these brushes will brush the inner sides of the foot and thigh; when reaching the groin, because of the opposition to movement met there, the brushes will move up, then will continue along the sides of the patient's body to brush the ribs area toward the armpits. Resistance to movement at the armpits will cause the brushes to move up and return to the edge of the bed.

Upper Cover

At the beginning of the washing process, a cover is over the patient, to cover all his/her body up to the neck. This cover preserves the patient's privacy during washing, and prevents water splashes and sprays in the surrounding area.

A blower may be installed there, to remove water vapors generated during washing.

Figure 21:
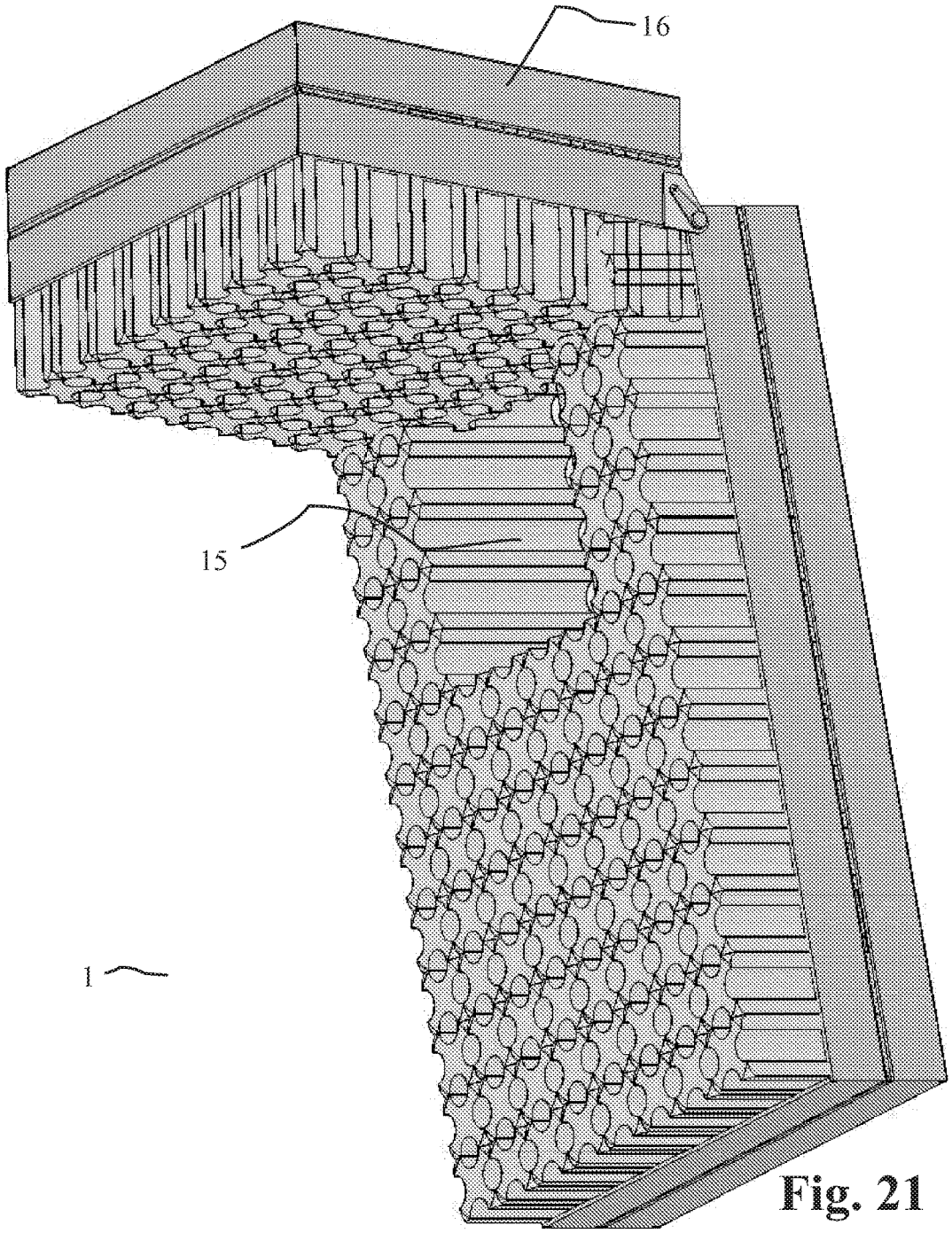
FIG. 21 illustrates the bed in its upright position and the opening for feces in its open state.

FIG. 21 illustrates the bed 1 in its upright position and the opening for feces 15 in its open state.

Also shown is the upper body part of the bed 16.

Figure 22:
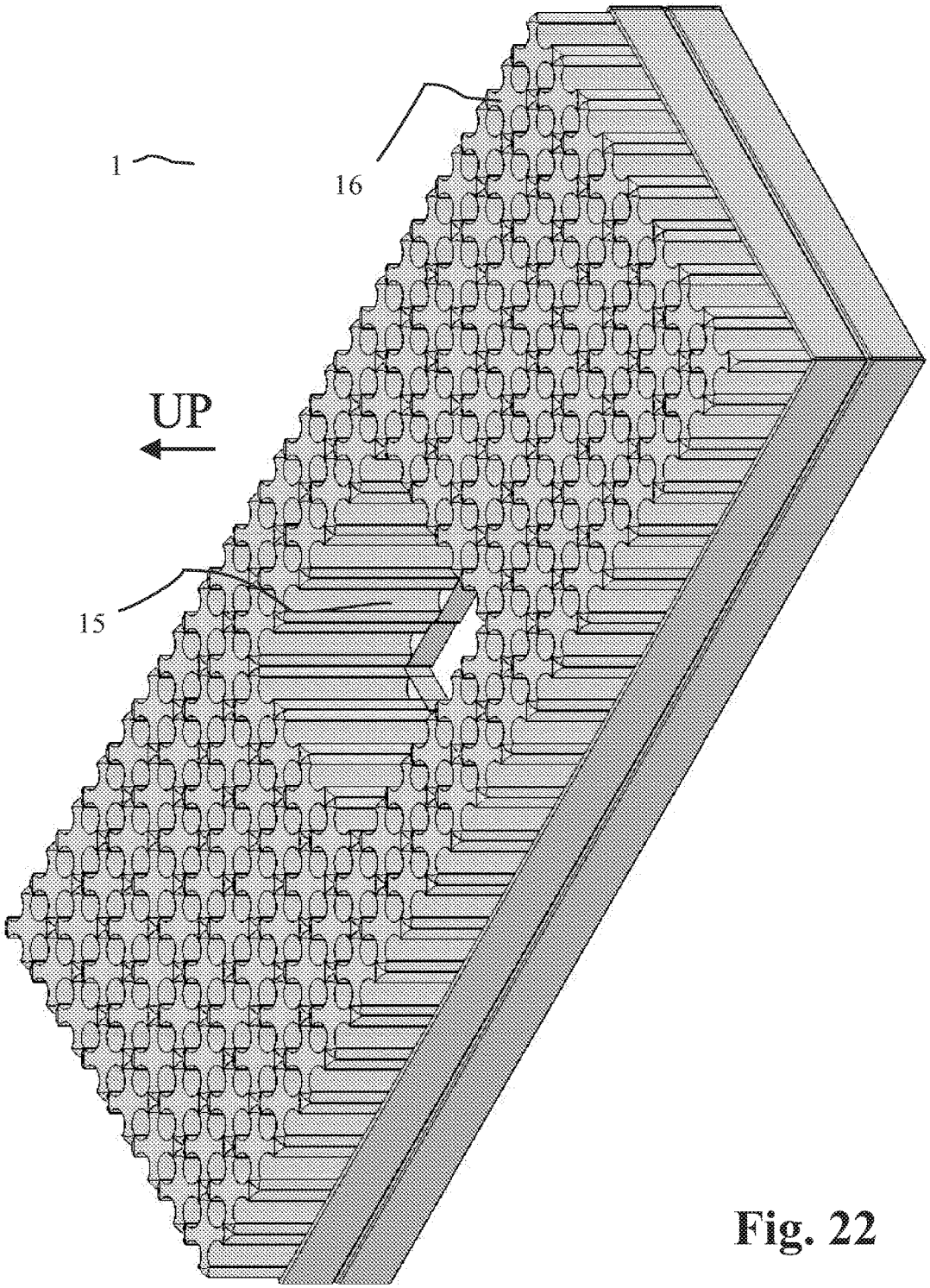
FIG. 22 illustrates the bed in its horizontal position and the opening for feces in its open state.

FIG. 22 illustrates the bed 1 in its horizontal position and the opening for feces 15 in its open state.

Also shown is the upper body part of the bed 16.

Figure 23:
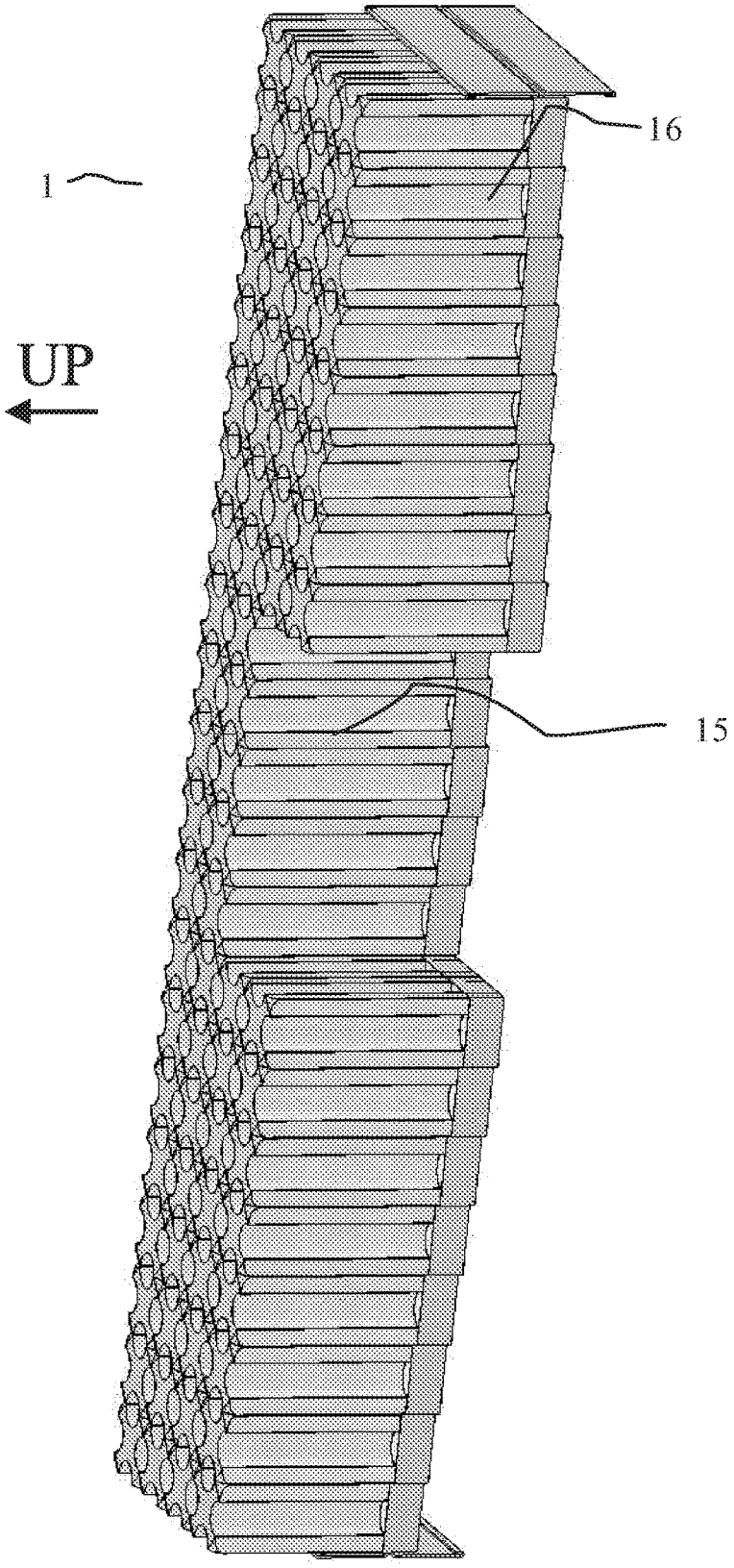
FIG. 23 illustrates a cross-sectional view of the bed in its horizontal position and the opening for feces in its open state.

FIG. 23 illustrates a cross-sectional view of the bed 1 in its horizontal position, and the opening for feces 15 in its open state.

Figure 24:
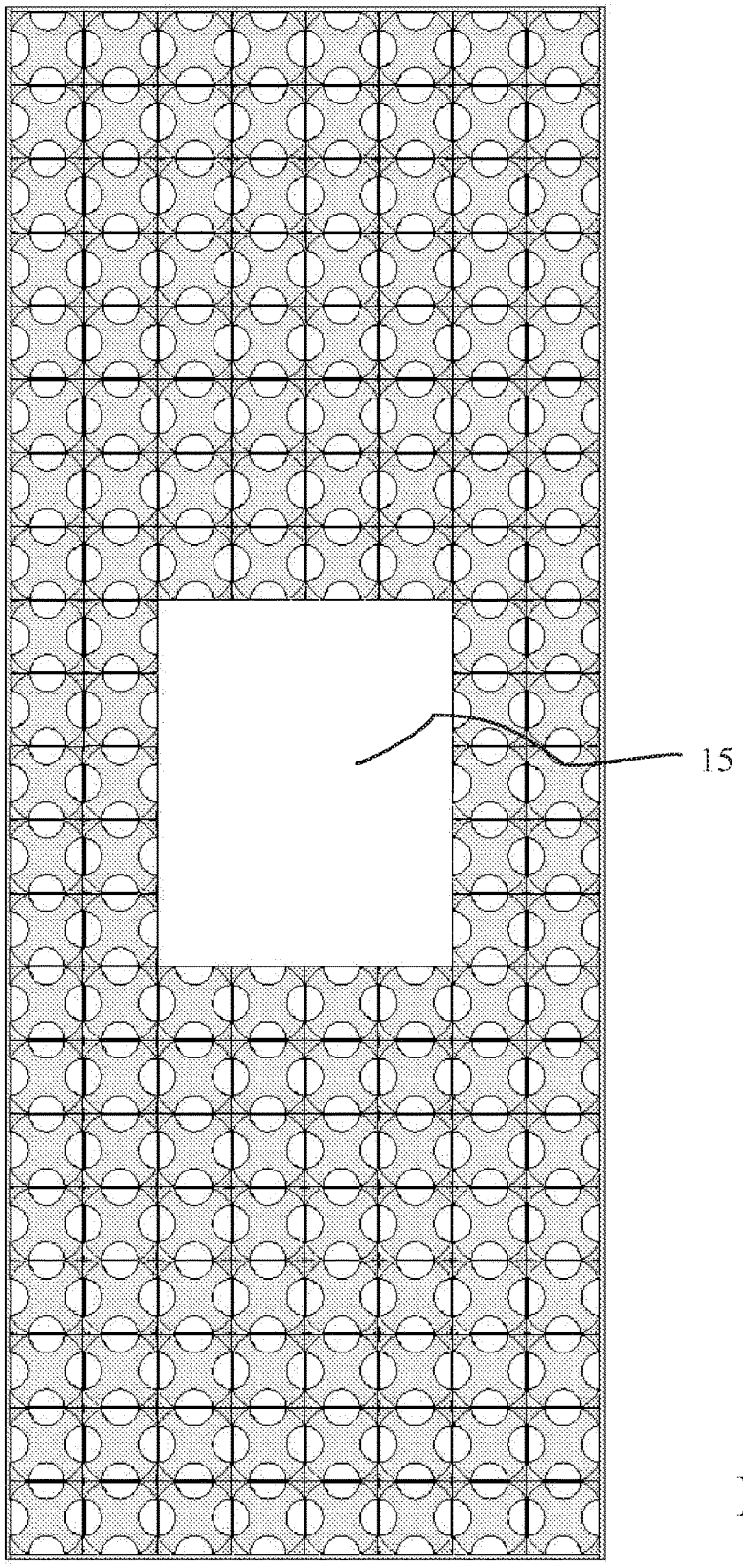
FIG. 24 illustrates a top view of the bed in its horizontal position and the opening for feces in its open state.

FIG. 24 illustrates a top view of the bed 1 in its horizontal position and the opening for feces 15 in its open state.

Figure 25:
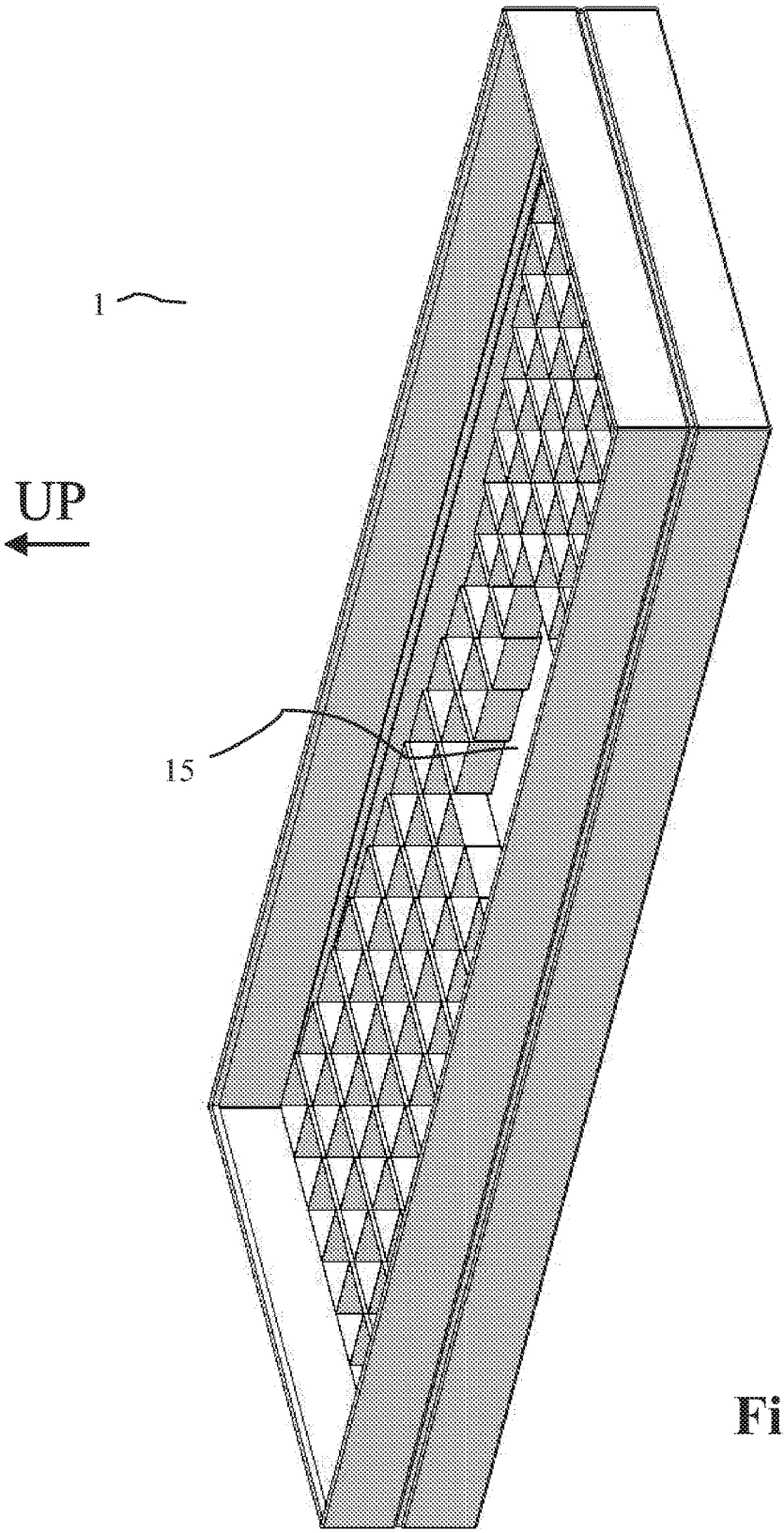
FIG. 25 illustrates the chassis of the bed, on which the cushions are mounted, without the cushions.

FIG. 25 illustrates the base or chassis of the bed 1, on which the cushions are mounted, without the cushions, and the opening for feces 15.

Note the curvature of the bed chassis, so devised as to comfortably support the patient's body.

Figure 26:
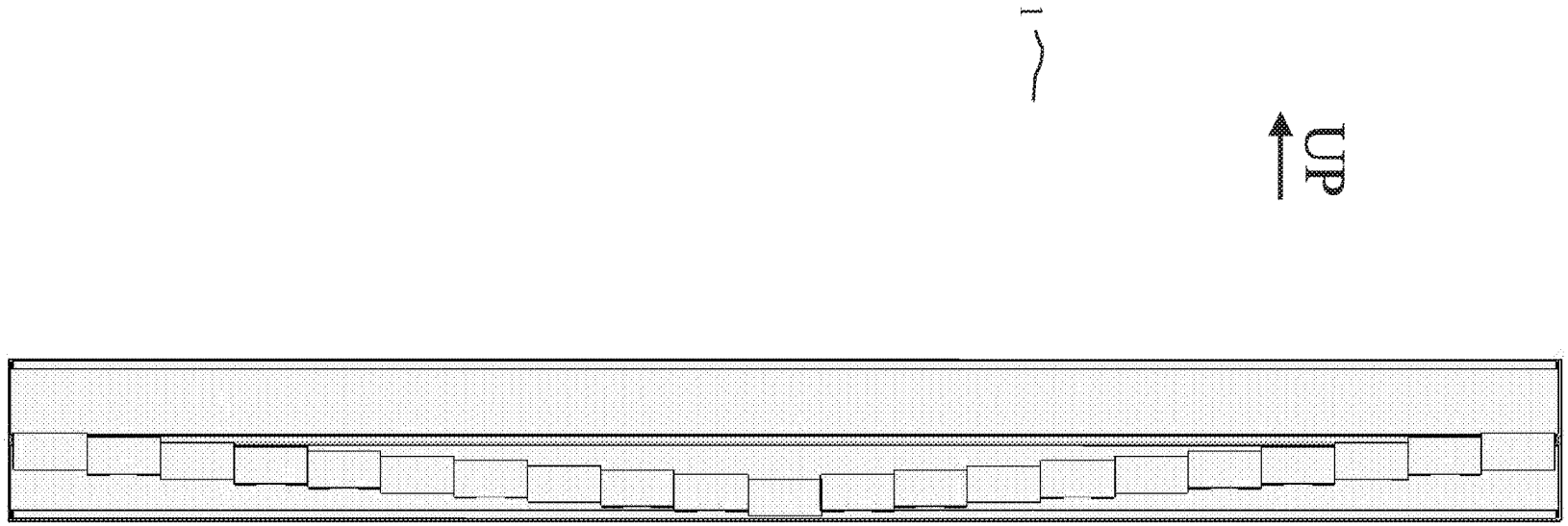
FIG. 26 illustrates a side view of the chassis of the bed, on which the cushions are mounted, without the cushions.

FIG. 26 illustrates a side view of the chassis of the bed, on which the cushions are mounted, without the cushions.

Figure 27:
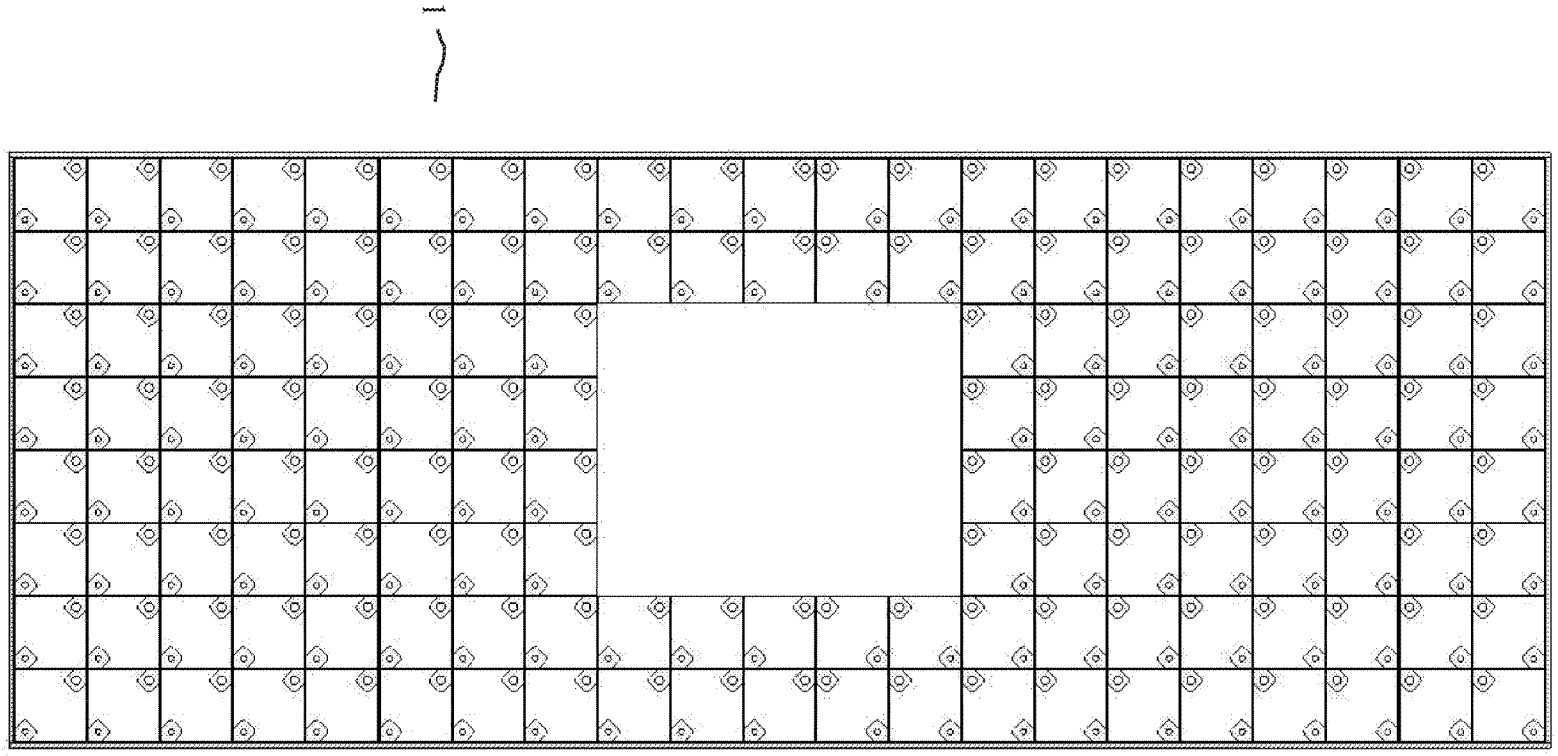
FIG. 27 illustrates a top view of the chassis of the bed.

FIG. 27 illustrates a top view of the chassis of the bed.

Figure 28:
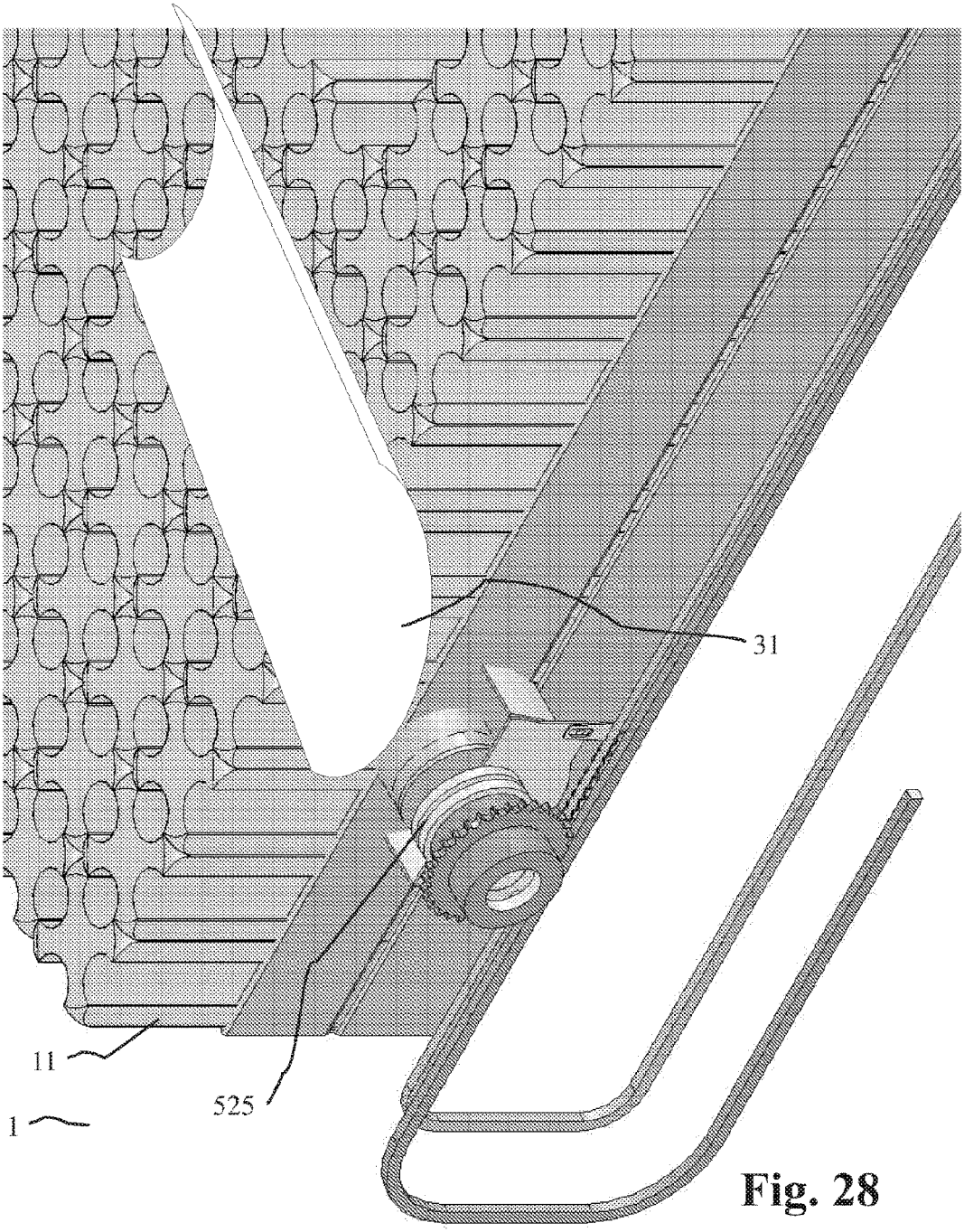
FIG. 28 illustrates the trough as it moves over the cushions in the bed.

FIG. 28 illustrates the trough 31 as it moves over the cushions 11 in the bed.

Also shown is the clutch 525.

FIG. 29 illustrates an isometric/top view cushion 11 in its inflated state.

The cushion comprises several telescopic parts 116, four parts in this embodiment.

FIG. 30 illustrates a side view of the cushion 11.

FIG. 31 illustrates a top view of the cushion 11.

FIG. 32 illustrates an isometric/bottom view of the cushion 11.

Figure 33:
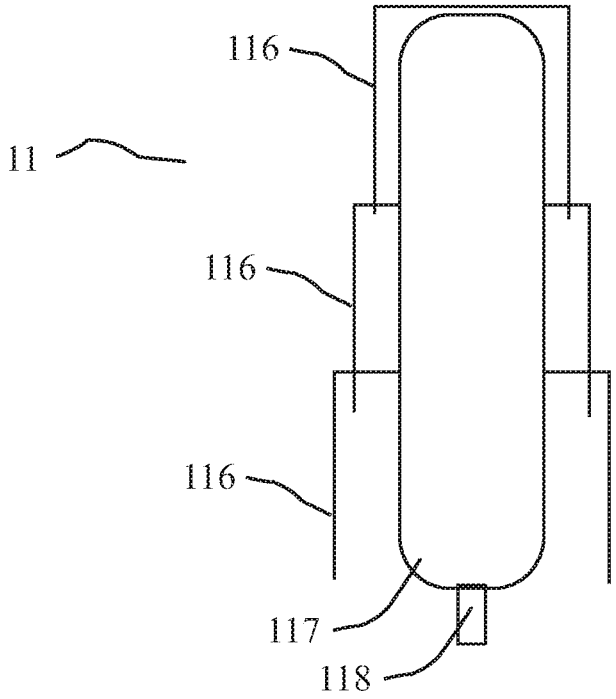
FIG. 33 illustrates a cross-sectional side view of a three parts cushion in its inflated state.

FIG. 33 illustrates a cross-sectional side view of a three parts cushion 11 in its inflated state.

The cushion 11 comprises several telescopic parts 116, three parts in this embodiment. Also shown is a balloon 117 with its balloon inflating/deflating outlet 118.

Figure 34:
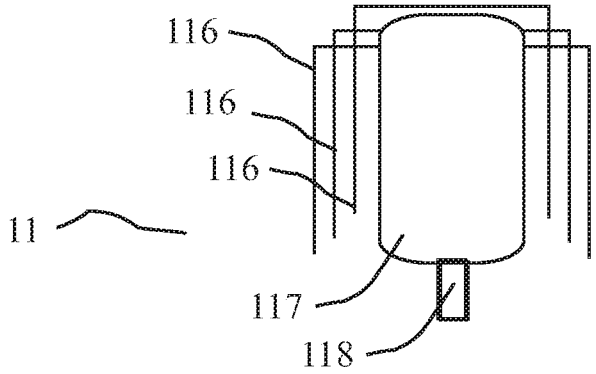
FIG. 34 illustrates a cross-sectional side view of a three parts cushion in its deflated state.

FIG. 34 illustrates a cross-sectional side view of a three parts cushion 11 in its deflated state.

The cushion 11 comprises several telescopic parts 116, three parts in this embodiment. Also shown is a balloon 117 with its balloon inflating/deflating outlet 118.

It will be recognized that the foregoing is but one example of an apparatus and method within the scope of the present invention and that various modifications will occur to those skilled in the art upon reading the disclosure set forth hereinbefore.

What is claimed is:

1. A bed with means for washing a patient who lies on the bed, without removing the patient from the bed, comprising a plurality of inflatable cushions fixedly mounted on a base, and means for washing the patient wherein the means for washing the patient include a rotating brush movable along the patient's back and a trough located between the rotating brush and said plurality of inflatable cushions.

2. The bed according to claim 1, wherein at least part of the cushions have one or more drainage channels made thereon, for allowing washing water and soap to flow down off the bed.

3. The bed according to claim 1, wherein the base is a flat surface; wherein the base with the cushions mounted thereon form a mattress on the bed.

4. The bed according to claim 1, wherein each cushion has an inflation inlet and a deflation outlet thereon.

5. The bed according to claim 1, wherein each cushion has an outlet usable for inflating and deflating the cushion.

6. The bed according to claim 5, further including, for each cushion, a valve mounted on a tube between the cushion and a source of pressurized air.

7. The bed according to claim 6, wherein each valve has two states, a first state wherein each respective cushion outlet is connected to the source of pressurized air, and a second state wherein the respective cushion outlet is disconnected from the source of pressurized air.

8. The bed according to claim 1, wherein the rotating brush and trough are movable along the patient's back along a pair of rails mounted on the two sides of the bed.

9. The bed according to claim 1, further including means for applying water or soap to a patient's body, and wherein the means for applying water or soap are movable along the patient's body together with the brush and trough.

10. The bed according to claim 9, wherein the trough is perforated for allowing drainage of the water and soap applied to the patient's body.

11. The bed according to claim 1, further including a reservoir for clean water and a waste reservoir.

12. The bed according to claim 1, further including means for connecting to outlets for clean water and waste located on a hospital premises.

13. The bed according to claim 1, wherein the means for washing the patient include rotating brushes used to wash the patient's front and sides, including inner sides of each foot and thigh, groin, ribs area and armpits.

14. The bed according to claim 1, further including means for drying up the patient's body and mattress.

15. The bed according to claim 1, further including means for removing the used sheet and replacing it with a clean sheet.

16. The bed according to claim 1, further including means for allowing the patient to defecate into an excrements reservoir located under the bed.

17. The bed according to claim 1, further including means for cleaning the patient's behind after defecating.

18. The bed according to claim 1, further including cover means deployable above the bed, for preserving the patient's privacy and for preventing water from splashing and spraying onto surroundings.

* * * * *